US007165360B2

(12) United States Patent
Thompson

(10) Patent No.: US 7,165,360 B2
(45) Date of Patent: Jan. 23, 2007

(54) MODULAR ROOM SYSTEM AND METHOD

(75) Inventor: Steven C. Thompson, Elkhart, IN (US)

(73) Assignee: L & P Property Management, South Gate, CA (US)

( * ) Notice: Subject to any disclaimer, the term of this patent is extended or adjusted under 35 U.S.C. 154(b) by 59 days.

(21) Appl. No.: 10/702,339

(22) Filed: Nov. 6, 2003

(65) Prior Publication Data

US 2004/0118054 A1 Jun. 24, 2004

(51) Int. Cl.
*E04H 1/00* (2006.01)

(52) U.S. Cl. ..... 52/36.1; 52/36.5; 52/298; 52/126.4

(58) Field of Classification Search ..... 248/677, 248/188.8, 188.1; 211/189, 191, 183; 52/36.1, 52/36.5, 36.6, 298, 239, 126.4
See application file for complete search history.

(56) References Cited

U.S. PATENT DOCUMENTS

| | | | | |
|---|---|---|---|---|
| 860,278 | A | | 7/1907 | Botkin |
| 1,637,145 | A | | 7/1927 | Hart et al. |
| 1,667,534 | A | | 4/1928 | Carpenter et al. |
| 2,001,574 | A | | 5/1935 | Jacobsen |
| 2,671,538 | A | | 3/1954 | Horowitz et al. |
| 3,151,745 | A | | 10/1964 | Reilly |
| 3,194,362 | A | | 7/1965 | Wargo |
| 3,209,869 | A | | 10/1965 | Hammitt |
| 3,213,580 | A | | 10/1965 | Mark |
| 3,245,181 | A | | 4/1966 | Stephenson |
| 3,348,346 | A | | 10/1967 | Heim et al. |
| 3,468,430 | A | | 9/1969 | Lawman |
| 3,733,759 | A | | 5/1973 | Schulte et al. |
| 3,769,773 | A | | 11/1973 | Mochizuki |
| 4,088,229 | A | | 5/1978 | Jacoby et al. |
| 4,136,811 | A | | 1/1979 | Sato |
| 4,197,685 | A | * | 4/1980 | Goulish et al. ..... 52/239 |
| 4,281,480 | A | | 8/1981 | Wendt |
| 4,281,481 | A | | 8/1981 | Wendt |
| 4,881,353 | A | | 11/1989 | Braendel et al. |
| 4,987,708 | A | * | 1/1991 | Wilcox ..... 52/126.6 |
| 5,036,638 | A | | 8/1991 | Kurtz, Jr. |
| 5,056,577 | A | | 10/1991 | DeLong et al. |
| 5,067,294 | A | | 11/1991 | McGowan |
| 5,392,575 | A | | 2/1995 | Hoffman et al. |

(Continued)

FOREIGN PATENT DOCUMENTS

| | | |
|---|---|---|
| JP | 6-108563 | 4/1994 |

*Primary Examiner*—Basil Katcheves
(74) *Attorney, Agent, or Firm*—Michael Best & Fredrich

(57) ABSTRACT

Some embodiments of the present invention employ a modular room including a plurality of modular room components (e.g., anchor assemblies, upright assemblies, etc.). These anchor assemblies and upright assemblies can take different forms permitting assembly of a modular room or modular structure in different manners, and in some cases provide for interchangeable interior and exterior wall panels and components. In some embodiments, a bracket assembly is coupled to an substantially vertical elongated upright for improved strength and stability. Preferably, the anchor assembly has a base plate with at least one edge at an angle with respect to the rest of the base plate for additional strength. If desired, the vertical position of the upright with respect to the base plate can be adjusted. In some embodiments, one or more overhead trusses are used to stabilize the walls of a modular room.

23 Claims, 28 Drawing Sheets

U.S. PATENT DOCUMENTS 5,568,909 A 10/1996 Timko
5,592,787 A 1/1997 Ophardt
5,630,302 A 5/1997 Rosenband
5,899,035 A 5/1999 Waalkes et al.
5,927,666 A 7/1999 Barkan
5,931,429 A * 8/1999 Hellwig et al. ..... 248/235
5,946,867 A 9/1999 Snider et al.
6,324,800 B1 12/2001 Valentz et al.
6,786,017 B1 * 9/2004 Thompson ..... 52/298

* cited by examiner 10
24
12
12
12

MODULAR ROOM SYSTEM AND METHOD

RELATED APPLICATIONS

This application claims priority to international patent application number PCT/US02/14353 filed on May 6, 2002 and to U.S. patent application Ser. No. 60/289,263 filed on May 7, 2001, the entire contents of which are incorporated herein by reference.

FIELD OF THE INVENTION

The present invention relates to room structures, and more particularly to modular rooms and modular room structures, methods for assembling such rooms and structures, modular room and structure components, and methods of assembling such components.

BACKGROUND OF THE INVENTION

Modular rooms and modular room structures are becoming increasingly attractive for use in a variety of consumer markets due to the modularity and design flexibility of such rooms and room structures. Modular rooms are typically employed when an additional room or structure is required within a larger structure. Among other purposes, such a room can be employed for pharmacies, eye care stores, banks, and other facilities within a store. Modular rooms are commonly free standing and are located at least partially within another larger structure, such as a grocery store, drug store, shopping center, or any other building or structure. However, the modular room can share a common wall with the larger structure. For example, the rear wall of the modular room structure may be one of the exterior or interior walls of the larger structure. A number of different modular room structures exist, and can be employed in a number of different fields and in a number of different applications. Such structures can be employed to connect and/or at least partially stabilize a modular room upon a floor, to connect portions of the modular room to a floor, to join wall panels to one another, and for a number of other purposes.

Modular rooms can be an alternative to conventional manners of constructing additional rooms within the larger structure (e.g., using cinderblock, walls of wood and sheetrock, etc.) or altering the larger structure to add an additional room. Both alternatives can be expensive, and can include costs associated with demolition, supplies, labor, etc. In addition, both alternatives create a permanent structure that can only be altered by incurring the costs of additional construction or demolition.

Modular rooms and modular room structures also provide significant advantages over conventional rooms and room structures relating to assembly, transport, disassembly, inventory, manufacturing. For example, modular rooms can often be assembled and disassembled as needed to simplify manufacturing, shipping, and assembly. However, current modular rooms still require a considerable amount of time (e.g., several weeks) to assemble and disassemble, and typically have a large number of components. As another example, many of the modular room structures employed to assemble modular rooms do not permit adjustment, make assembly difficult, and are weak or unstable.

Compounding these problems is the fact that many conventional modular room components, though similar in shape and function, are not interchangeable with one another. The ability to quickly assemble and disassemble modular room structures is desirable due to the often heavy costs of space and lost business, as well as other factors associated with "down time" of a company or operation that would otherwise be using the room structure (such as to conduct business). Similar components that have a variety of sizes, such as, wall panels, cross stretchers, and primary uprights can increase the cost of manufacturing a modular room or structure, can increase the complexity of assembling and disassembling the modular room or structure, and can result in a room or structure that requires a longer time to assemble and disassemble.

Some existing modular rooms and modular room structures lack sturdiness and can be damaged or ultimately collapse under heavy loads, external forces, and vibration. Modular rooms and modular room structures can particularly lack sturdiness as a result of being loaded by shelving, fixtures, equipment, and other elements and structure attached thereto or otherwise exerting force thereon. In addition, modular rooms and other structures must often withstand earthquakes and minimum loading thresholds as required by law.

Another design issue with regard to modular rooms and modular room structures is related to the floor or other surface upon which such a room or structure is assembled. Specifically, some current modular rooms are not well-suited for areas where the floor surface is uneven or sloping. If such modular rooms are located in areas with uneven or sloping floors, problems can arise with regard to assembly and structural instability.

Still other problems with many existing modular rooms and modular room structures are related to the aesthetic appearance of such rooms and structures. For example, many modular rooms and modular room structures have only a single exterior color scheme, therefore making it difficult to match the color scheme of a surrounding structure or environment. In addition, current modular rooms and modular room structures are often aesthetically unpleasing due to visible structural elements, fasteners and fastening features, and the like.

Due to the design of many components of conventional modular rooms and structures, users are often significantly limited in their ability to change the modular room or structure to other configurations. In many cases, a user is therefore only able to assemble the modular room or structure in one manner. Such inflexibility often presents problems during planning and installation of conventional modular rooms and structures.

With reference now to FIGS. 35 and 36, a problem inherent in the design of conventional modular rooms is the inability to employ standardized room components (such as wall panels, stretchers, doors and door frame, fixtures, and the like) in both interior and exterior locations of the modular room. As will now be described, this problem stems at least in part from the type of modular room components that are commonly employed in conventional modular room designs.

Conventional modular rooms employ uprights that define part of the "skeleton" of the modular room. Wall panels and other room components having standard sizes are attached to and are supported by the uprights to define the walls and perimeter of the modular room. For purposes of reduced inventory, easier and less expensive manufacturing and assembly, and room design flexibility, it is desirable to have a minimum number of different wall panel types and a minimum number of different room components for a modular room. For example, standardized wall panels available in a limited number of widths (e.g., 24", 32" and 48") are preferred over wall panels that must be manufactured in more sizes or to custom dimensions. In addition, it is desirable to employ uprights that are relatively inexpensive and occupy as little space as possible. Accordingly, conventional uprights are commonly designed for connection to wall panels, stretchers, and other room components on fewer than all sides of the uprights. For example, many conventional uprights are provided with mounting apertures, fixtures or other mounting features on only two of four sides of each upright. Such a design enables the other sides of the upright to be used for mounting or hanging fixtures and other elements upon the upright, and can facilitate the use of more efficient upright cross-sectional shapes (such as elongated rectangular shapes).

Unfortunately, the use of uprights as just described is at odds with the use of standardized modular room wall panels and other modular room components. This is particularly evident in cases where a user desires to employ the same size modular room wall panels or other modular room components in the interior and exterior of the modular room. With continued reference to FIG. 35 for example, the exterior and interior wall panels W of the modular room M have the same length only because the primary uprights P to which they are connected enable wall connections on more than two sides and because the primary uprights P occupy the same amount of space in both planar dimensions (e.g., the primary uprights P are square). As mentioned above, this is not a highly desirable design for modular rooms because the primary uprights P do not have an optimal shape (i.e., efficiently shaped for connection on less than all sides and having a reduced cross-sectional size). In other words, the primary uprights P must be adapted to be connected to wall panels and other wall components on three or more sides, must therefore be designed for sufficient load-bearing capacity on such sides, and are typically larger and bulkier in order to carry loads in this manner.

With reference now to FIG. 36, primary uprights can be employed that are smaller and/or are adapted for connection to wall panels and other wall components on less than all sides. However, to connect interior wall panels and other wall components, more than one primary upright P is needed. For example, at each wall joint where two exterior wall panels W and an interior wall panel W' are joined, two primary uprights P are needed as shown in FIG. 36. Accordingly, the interior wall panel W' must be smaller than the exterior wall panels W in order for the interior wall panels P to properly meet. Therefore, different interior and exterior wall panels must be supplied to construct the modular room—a result that is highly undesirable as described in greater detail above. Similar problems arise with modular room components to be used on the both exterior and interior of the modular room.

In light of the problems and limitations of the prior art described above, a need exists for modular room structures that are quick and easy to assemble and disassemble, sturdy, aesthetically pleasing, can match color and design schemes of the larger structures, and can take a variety of shapes and sizes. Each preferred embodiment of the present invention achieves one or more of these results.

SUMMARY OF THE INVENTION

In order to address many of the problems and limitations of the prior art described above, some embodiments of the present invention employ a modular room including a plurality of modular room components (e.g., anchor assemblies, upright assemblies, etc.). These anchor assemblies and upright assemblies can take different forms permitting assembly of a modular room or modular structure in a number of different manners. This flexibility enables a user to assemble a modular room or structure in different sizes, shapes and layouts using a relatively small number of elements and components. By assuming a variety of different sizes, shapes and layouts, the modular room or modular room structure can be flexible to accommodate different layouts of larger structures in which the modular room can be located.

As discussed above, it is also desirable to have a modular room or a modular room structure that is quick and easy to assemble and disassemble and preferably employs modular elements and components. Some embodiments of the present invention employ a reduced number of different component and element types (e.g., sizes), thereby simplifying manufacturing and assembly and reducing the cost of such operations. For example, some or all of the components and elements of a modular room that are employed to construct an exterior wall of the modular room are preferably the same as those employed to construct an interior wall of the modular room.

For purposes of increased stability and strength, some embodiments of the present invention have an upright assembly that includes a substantially vertical elongated upright and a bracket coupled to a bottom end of the upright. The upright can have a wall partially defining an interior of the upright and at least one aperture in the wall. The bracket can have a first portion received within the aperture of the upright that extends into the interior of the upright and releasably connects at a distal end to an interior wall of the upright. The bracket can also have a second portion extending away from the upright to a location where a leg or foot on the bracket rests upon the ground or floor. Mounting the bracket to the upright in this manner can transfer at least some of the horizontal force exerted on the wall of the upright in a vertical direction along the upright. In many cases, uprights have more strength in the vertical direction than in the horizontal direction. Therefore, transferring at least some force exerted by the bracket upon the sidewall of the upright away from the sidewall results in a stronger and more stable upright.

Some embodiments of the present invention employ anchor assemblies for connecting one or more uprights of a modular room to the ground or a floor. Preferably, the anchor assembly includes a base plate having a plurality of edges. At least one of the edges can be bent, stamped, formed or otherwise shaped at an angle with respect to the rest of the base plate. By employing such angled base plate edges, a stronger and more stable anchor plate results. The angled edge(s) can resist deformation from bending moments transmitted from the upright to the anchor assembly, thereby increasing the stability of the modular room or modular room structure employing such anchor plates.

In some embodiments of the present invention, one or more overhead trusses are used to stabilize the walls of a modular room. In other embodiments of the present invention, one or more overhead trusses are connected to walls, uprights, or other structure, such as shelving or other product storage and display units. Preferably, one or more of the trusses includes a first panel, a second panel that is substantially co-planar with respect to the first panel and in end-to-end relationship with the first panel, and a beam coupled to the first and second panels. The beam preferably spans and couples the first and second panels together. By employing this type of overhead truss structure, the overhead trusses can be more easily manufactured, transported, and installed without sacrificing the strength and stability previously thought only available in unitary truss structures.

As discussed above, it is also desirable to have a modular room that can be located on uneven ground without loss of stability. Some embodiments of the present invention have a modular room upright assembly adapted to be coupled to the floor. The upright assembly can include an elongated and substantially vertical upright, a base plate, and a foot coupled to the bottom end of the vertical upright via a threaded connection and resting upon the base plate. Preferably, the threaded connection is adjustable to raise and lower the upright with respect to the base plate and the floor. The ability to adjust the height of the upright in this manner enables a user to construct a stable modular room on uneven ground. Fixtures and other wall components can be more easily connected between adjacent uprights by virtue of their common height with respect to the floor.

It is also desirable to have a modular room that has interior and exterior wall panels and/or wall components and elements of the same width. As used herein and in the appended claims, the term "width" (in reference to a wall panel or wall components extending between uprights) refers to the dimension of a wall panel or wall panel component in a horizontal direction as opposed to a vertical direction. The "width" of a wall panel or wall panel component may also be thought of as the horizontal length of the wall panel or wall panel component. Some embodiments of the present invention employ anchor plates that, when arranged as desired to define exterior walls of a modular room, permit the same wall panels in exterior walls of a modular room to be used for interior walls of the modular room. This capability is beneficial because a reduced number of "standard-sized" wall panels and wall components can be manufactured rather than manufacturing a variety of wall panels having various widths. In addition, interchangeability of wall panels and wall panel components is significantly increased.

It is also desirable to have a modular room that is aesthetically pleasing. Some embodiments of the present invention have a modular room wall assembly having a substantially vertical upright that has an elongated body, a plurality of sidewalls and a plurality of apertures along the elongated body defined in a first sidewall of the plurality of sidewalls. The wall assembly can also include a wall panel coupled to a second sidewall of the plurality of sidewalls and a modesty strip releasably coupled to and running along at least part of the elongated body. The modesty strip can cover at least some of the plurality of apertures in the sidewall. A modular room having such modesty strips can be aesthetically pleasing due to the modesty strip covering at least some of the plurality of apertures to give the appearance of a substantially continuous exterior wall.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

DETAILED DESCRIPTION OF THE PREFERRED EMBODIMENTS

Figure 1:
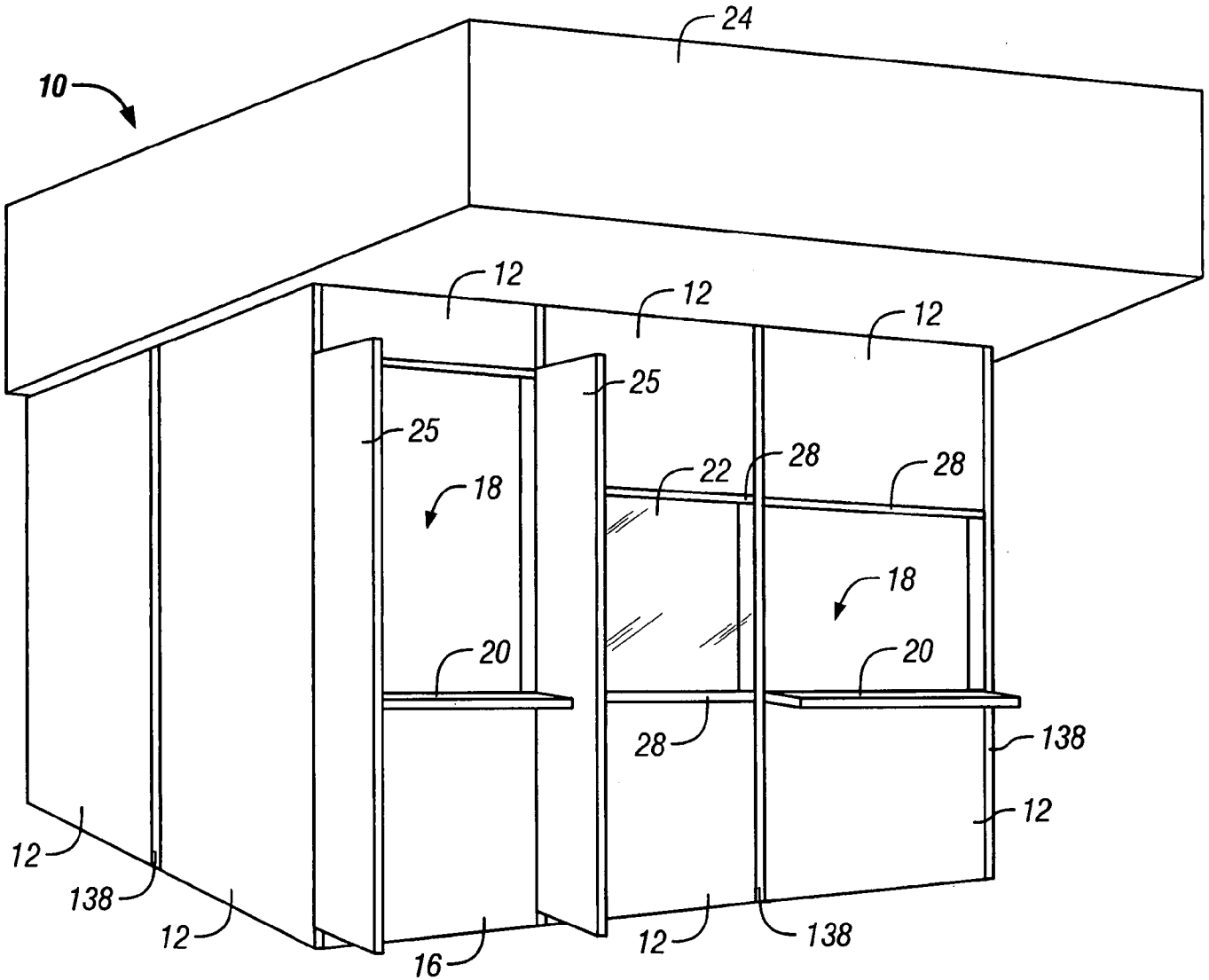
FIG. 1 is a perspective view of a modular room according to a preferred embodiment of the present invention.

A modular room according to a preferred embodiment of the present invention is shown in FIG. 1, and is indicated generally at 10. In its various embodiments, the modular room 10 of the present invention is located partially or fully in another structure, such as a department store or other type of retail store, a shopping mall, or the like. Although the most preferred embodiments of the present invention are internal with respect to another surrounding structure, it should be noted that one or more walls of the room 10 can define an external wall of such a structure in other embodiments.

With continued reference to FIG. 1, the modular room 10 employs elements and structure that permit rapid assembly of the room 10. The room 10 preferably employs a number of standardized components and assemblies enabling such assembly. As described in greater detail below, these components and assemblies can include anchor plates, primary vertical posts or "uprights" connected to the anchor plates, horizontal beams or "stretchers" connecting the uprights, secondary vertical posts or "uprights" connected to the stretchers, panels connected to the uprights and/or stretchers, soffit frame members, overhead trusses, and internal and external fixtures. The use of standardized components also reduces the manufacturing costs of the modular room 10, lowers assembly training, time, and cost, and simplifies the process of designing rooms 10 adapted for different location shapes and sizes. With regard to room design, the modularity of the present invention permits room designs to be highly specialized (if desired) and to be assembled in any number of configurations to satisfy a wide variety of parameters and requirements that may be encountered in different environments, while still using the same modular room components, assemblies, and assembly methods as rooms having much simpler or different designs.

The modular room 10 in the illustrated preferred embodiment has a number of wall panels 12 connected to primary uprights 14 (optionally covered by modesty strips in FIG. 1), a door 16, pass-thrus 18, countertops 20, a window 22, a soffit 24 and privacy panels 25. Other room types can have any number (including none) of any one or more of these elements and assemblies. Although the rooms illustrated in the figures are generally rectangular or square in shape, it should be noted that the modular components of the present invention can be arranged to result in a room that has any other shape desired, including without limitation, L-shaped, T-shaped, and cross-shaped rooms. Modular rooms having angled wall sections can be achieved with relatively minor modifications to present designs, as are window elements that are wider than the space between two adjacent primary uprights 14.

Figure 2:
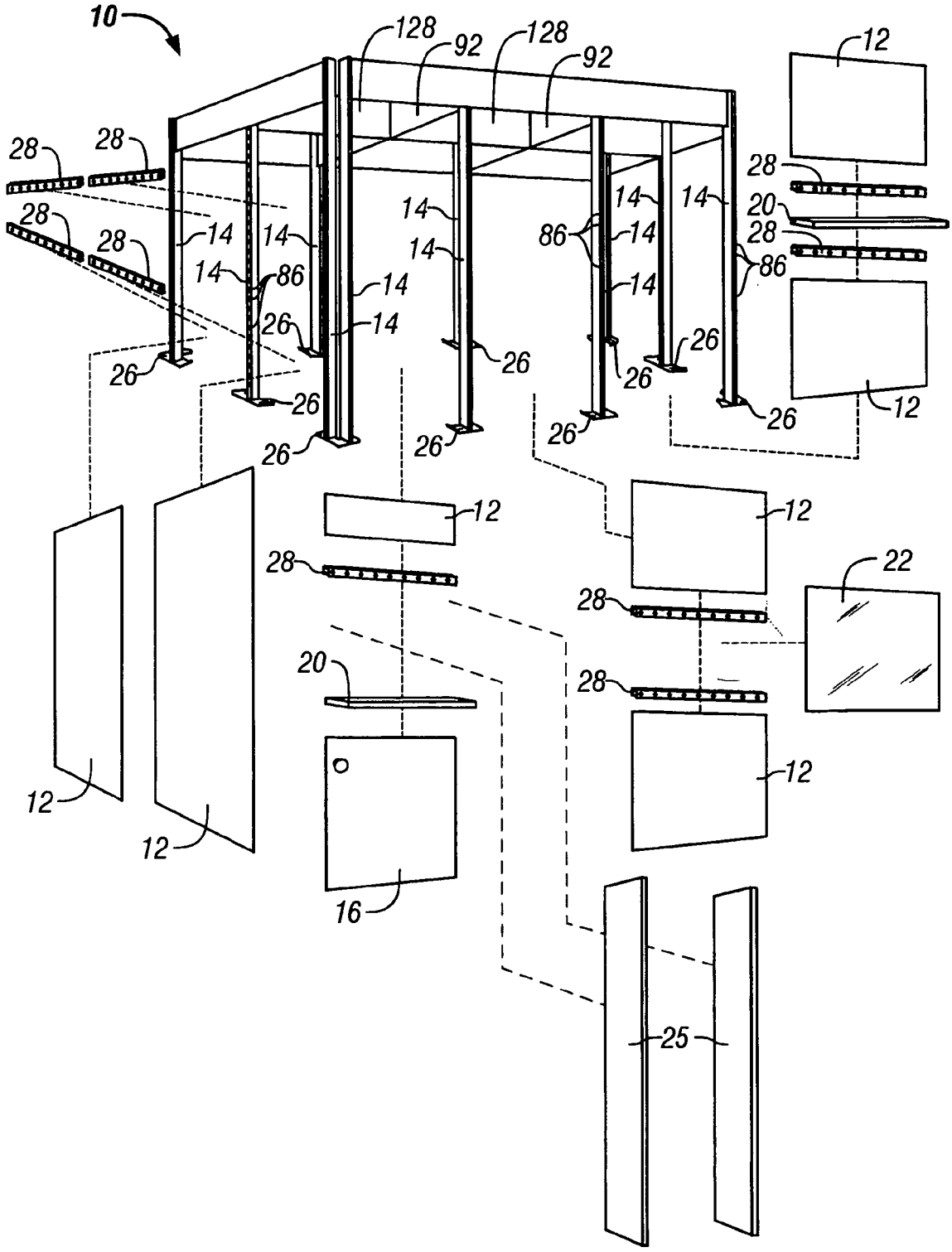
FIG. 2 is a partially exploded perspective view of the modular room illustrated in FIG. 1.
Figure 3:
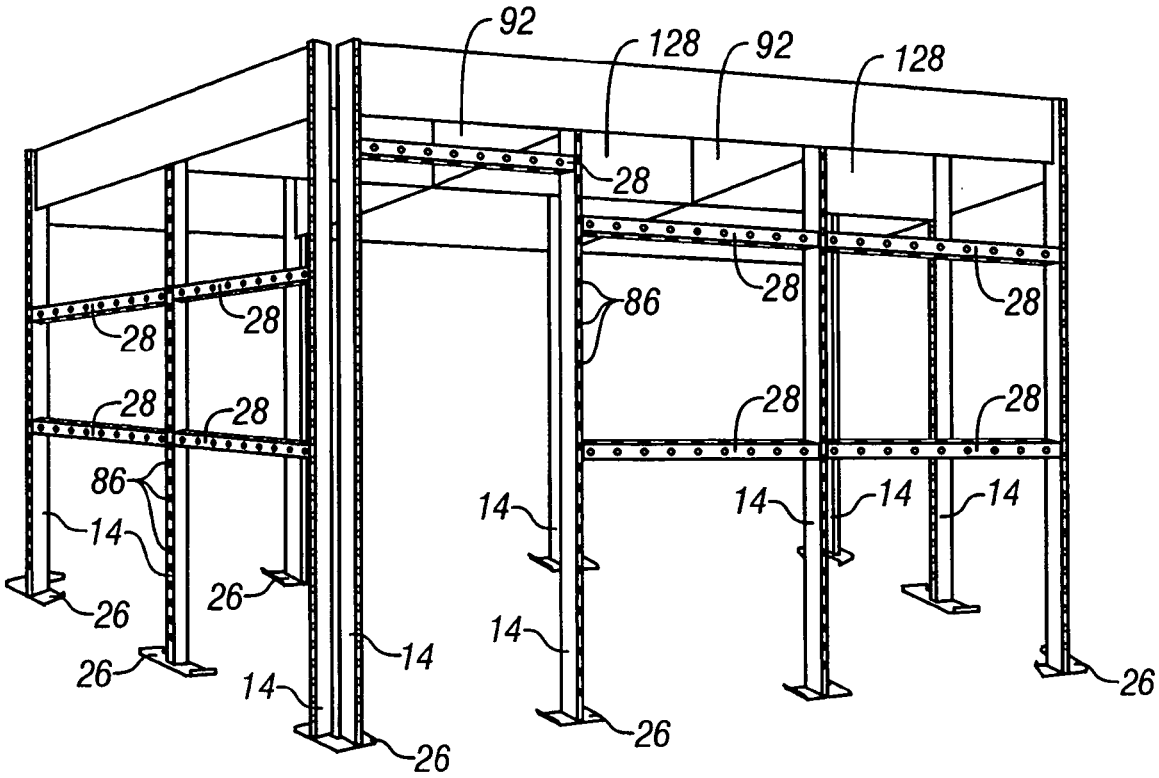
FIG. 3 is a perspective view of the modular room illustrated in FIG. 2, shown with several external elements removed.

FIGS. 2 and 3 provide additional details regarding the modular room 10 illustrated in FIG. 1. In FIG. 2, the modular room 10 is shown partially exploded, while in FIG. 3, a number of the components of the modular room 10 (such as the wall panels 12, door. 16, pass-thru 18, countertops 20, window 22, soffit 24 and privacy panels 25) are completely removed for purposes of clarity.

With additional reference to FIGS. 4-8, some embodiments of the present invention have one or more anchor assemblies 26, stretchers 28, mop boards 30 having apertures 32 defined therein, secondary uprights 34, base leg bracket assemblies 36, kick plates 38, cover plates 40 and end plates 42 as will be discussed in more detail later herein. As will be described in greater detail below, primary uprights 14 are connected to or are seated within anchor assemblies 26, extend generally vertically, and are connected together by stretchers 28 to form a "skeleton" of the modular room 10. In some embodiments, the secondary uprights 24 are connected to the stretchers 28 to further define the "skeleton" of the modular room 10. If desired, one or more base leg bracket assemblies 36 can be employed to provide additional support to the primary uprights 14. Wall panels 12 can be connected to the primary uprights 14, secondary uprights 24 and/or stretchers 28 to define the walls of the modular room 10. In addition, any number of doors 16, pass-thrus 18, countertops 20, windows 22, soffits 24, privacy panels 25, and mop boards 30 can be directly or indirectly connected to the primary uprights 14 and/or secondary uprights 24. If desired, one or more bases (such as gondola-type bases) can be connected to the primary and/or secondary uprights 14, 24, and can even be defined by kick plates 38, cover plates 40, and end plates 42 connected to base leg bracket assemblies 36.

In many embodiments of the present invention, assembly of the modular room 10 begins with placing and securing a number of anchor assemblies 26 upon a floor surface (which can be concrete, or can even be metal, wood, earth, or any other preferably stable floor surface). The anchor assemblies 26 are preferably secured to a floor in places where primary uprights 14 are to be located. The anchor assemblies 26 each preferably have a base plate 44 and at least one upright member 46 connected thereto. The base plate 44 can be secured to the floor in any conventional manner, but is most preferably anchored thereto using one or more conventional anchor bolts 48 (see FIGS. 4–18). Other types of fasteners can instead be used as desired. The type of fastener used depends at least partially upon the surface to which the anchor assembly 26 is attached. For example, anchor bolts or masonry nails could be used for a concrete floor. Alternatively, bolts, wood screws, or other threaded fasteners could be used for a wooden floor. As another example, welds or rivets could be used for a metal floor. One having ordinary skill in the art will appreciate that still other types of fasteners or fastening methods can be used with each floor type.

With reference to FIGS. 9–23, various constructions of anchor assemblies 26 are illustrated and can all be used in the modular room 10 illustrated in FIGS. 1–3. The various constructions of anchor assemblies 26 allow the room 10 to be highly specialized (if desired) and to be assembled in any number of configurations to satisfy a wide variety of parameters and requirements that may be encountered in different environments. The various anchor assemblies 26 can also be used in various locations and have various functions within the room 10. More particularly, the anchor assemblies 26 can be used in corners of the room 10, along exterior walls of the room 10, and to form interior rooms/areas within the exterior walls of the room 10.

In those cases where threaded fasteners or anchor bolts 48 are employed as shown in the figures, the anchor assemblies 26 preferably have apertures 50 through which the threaded fasteners or anchor bolts 48 pass. Each anchor assembly 26 can be secured to the floor with any number of fasteners desired. Most preferably however, each anchor assembly 26 is secured to the floor with at least two fasteners 48.

The upright members 46 can be connected to the base plate 44 of each anchor assembly 26 in any conventional manner, but most preferably are connected thereto by welds (not shown). In other embodiments, the upright members 46 can even be integral with the base plate 44, or can be connected thereto with adhesive or cohesive bonding material, one or more screws, rivets, bolts, or other conventional fasteners, inter-engaging elements, and the like. The upright members 46 preferably extend vertically from the base plate 44, and can also extend at a non-orthogonal angle with respect thereto if desired. The upright members 46 shown in the figures are C-shaped channels that can face one another or can be in any other orientation with respect to one another (in those cases where two or more upright members 46 are used with the same base plate 44). As will be discussed in greater detail below, the upright members 46 serve as a structural connection for the ends of the primary uprights 14. Other upright member shapes can be employed to perform this same function. By way of example only, any one or more of the C-shaped channels in FIGS. 9–23 can be replaced by tube sections having any cross-sectional shape, by angle irons, I-beams, solid bars or posts, or elements having any other cross sectional shape. In addition to other advantages provided by C-shaped channels (described in greater detail below), C-shaped channels are preferred due to their relatively high strength-to-weight ratio and their relatively low cost.

The primary uprights 14 are preferably secured to the anchor assemblies 26 via the upright members 46 on the anchor assemblies 26. In the illustrated preferred embodiments, the lower ends of the primary uprights 14 are each placed adjacent to at least one upright member 46 and are attached thereto by one or more threaded fasteners 52 passed through apertures in the upright members 46 and the primary uprights 14. Where C-shaped upright members 46 are employed, the ends of the C-shaped members preferably contact the primary uprights 14 as best shown in FIGS. 11, 14, 17 and 20. However, any relative orientation of the upright members 46 with respect to the primary uprights 14 is possible and falls within the spirit and scope of the present invention. For example, the C-shaped upright member 46 can be oriented such that it contacts a primary upright 14 with the middle section or a side of the C-shaped upright member 46. In this regard, any manner of contact between the upright member(s) 46 and the primary upright 14 also falls within the spirit and scope of the present invention. By way of example only, the upright members 46 in the illustrated preferred embodiments contact the primary uprights 14 along the edges of the C-shaped upright members 46, thereby establishing line contact with the C-shaped upright members 46. Such contact is highly preferred for its capacity to firmly hold an upright member 46 in a desired position.

However, the upright member(s) 46 of an anchor assembly 26 can contact a primary upright 14 in any other manner desired. By way of example only, such contact can be across one or more planar surfaces of an upright member 46 abutting the primary upright 14, can be one or more points of contact, or the like. The manner in which the upright member 46 contacts the primary upright 14 depends at least in part upon the shape of the upright member 46 (discussed above). For example, an upright member having an I or U-shaped cross-section can have the same type of contact with the primary upright 14 as a C-shaped upright member 46. As another example, a tube, post, or a bar or plate-shaped upright member 46 can be clamped against a side of the upright member 46 to be in planar contact with the upright member 46. In still other embodiments, an angle iron provides line contact with the primary upright 14.

Preferably, the fastener(s) 52 used to connect the primary uprights 14 to the upright members 46 not only hold these elements together, but also exert a clamping force with the upright members 46 upon the primary uprights 14 for a more rigid connection. In some embodiments of the present invention, the fasteners 52 are threaded through threaded apertures in the upright members 46 and can be tightened against the lateral walls of the primary uprights 14 to hold the primary uprights 14 in place. In other embodiments, the fasteners 52 are threaded through threaded apertures in the primary uprights 14 in order to draw the primary uprights 14 firmly against the upright members 46. In still other embodiments, the fasteners 52 are passed through non-threaded holes in the upright members 46 and the primary uprights 14 and can clamp the upright members 46 against the primary uprights 14 by tightening a nut or other such element on the fastener 52. Other manners of clamping the primary uprights 14 in place with respect to the upright members 46 using fasteners are possible, each one of which falls within the spirit and scope of the present invention.

With continued reference to FIGS. 9–23, the primary uprights 14 can be connected to multiple upright members 46 if desired, such as by being sandwiched between two upright members as shown in FIGS. 9–11, 15–17 and 22. In these cases, separate fasteners can be used to connect each upright member 46 to the primary upright 14, or the same fasteners can be used to connect two or more upright members 46 to the primary upright 14 as shown in FIGS. 9–11, 15–17 and 22. Any number of fasteners located at any desired position relative to the upright members 46 and primary upright 14 can be used.

Figure 9:
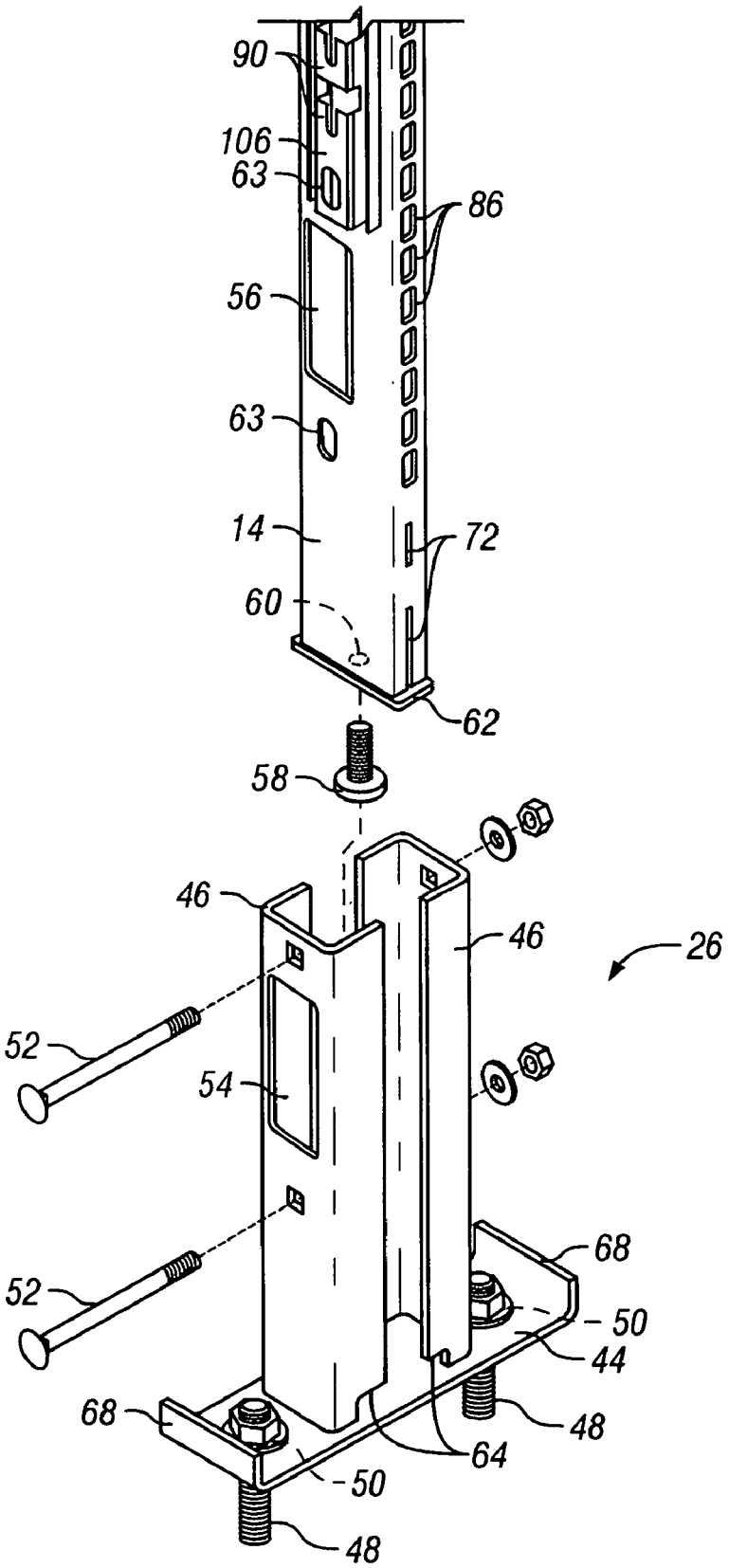
FIG. 9 is an exploded perspective view of a first anchor assembly and primary upright of the modular room illustrated in FIG. 1.
Figure 10:
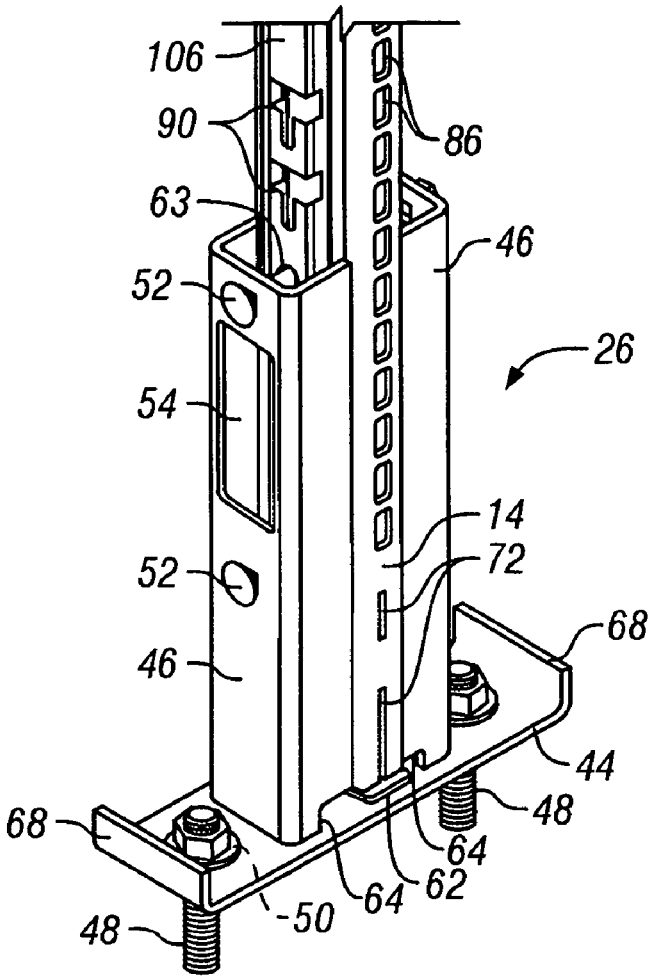
FIG. 10 is an assembled perspective view of the first anchor assembly and primary upright illustrated in FIG. 9.
Figure 11:
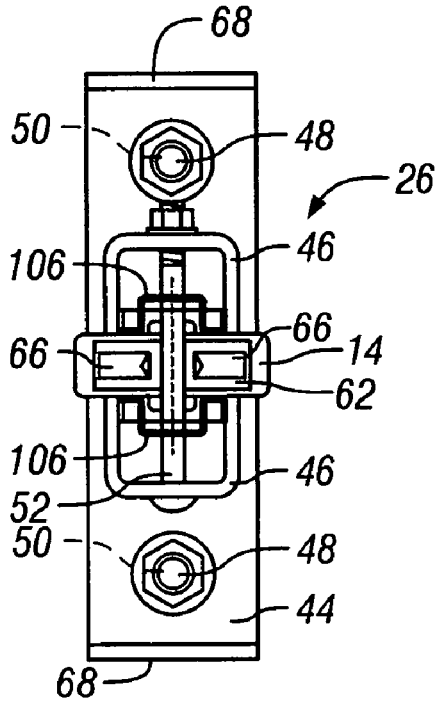
FIG. 11 is a top view of the first anchor assembly and primary upright illustrated in FIG. 10.
Figure 12:
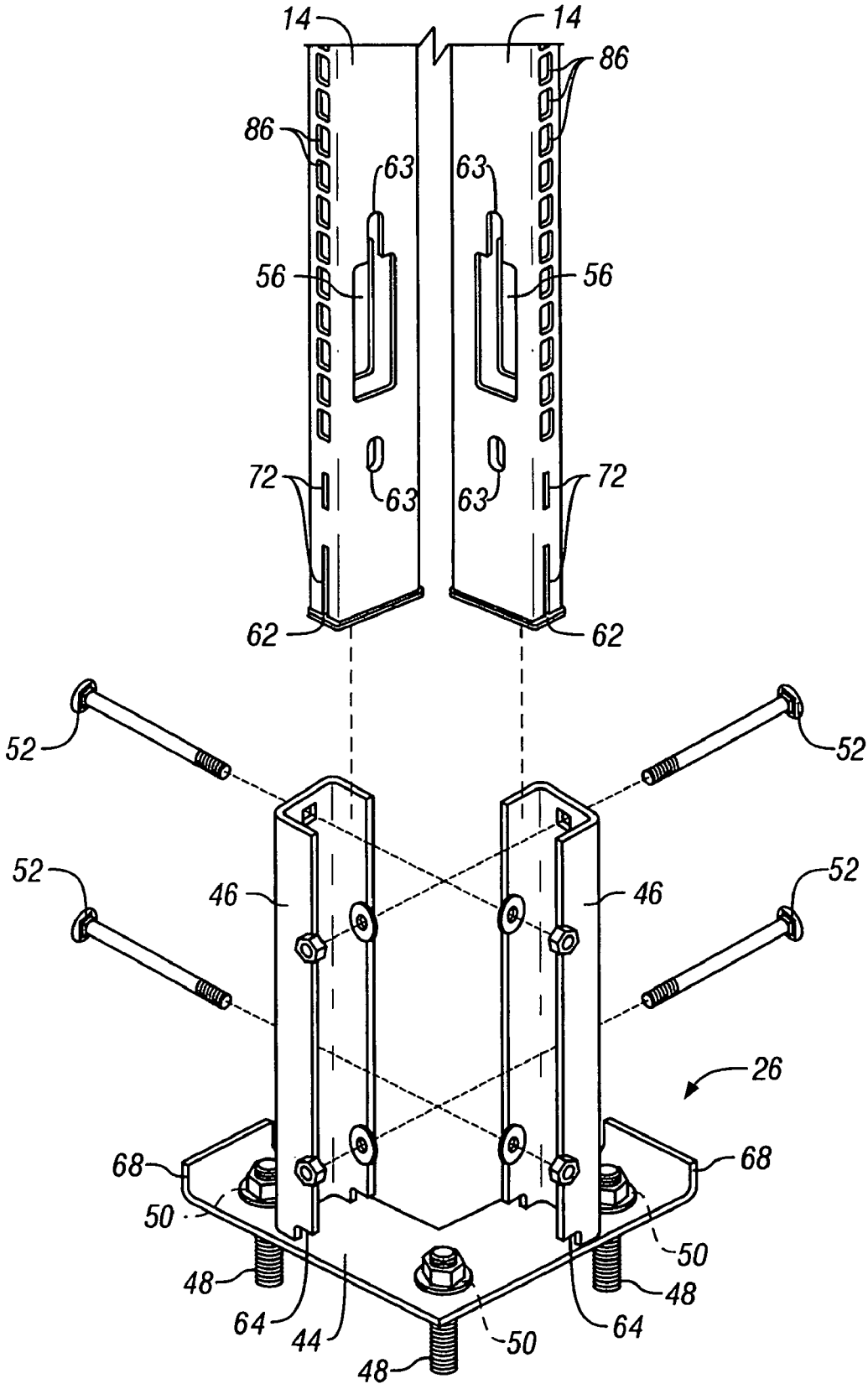
FIG. 12 is an exploded perspective view of a second anchor assembly and two primary uprights of the modular room illustrated in FIG. 1.
Figure 13:
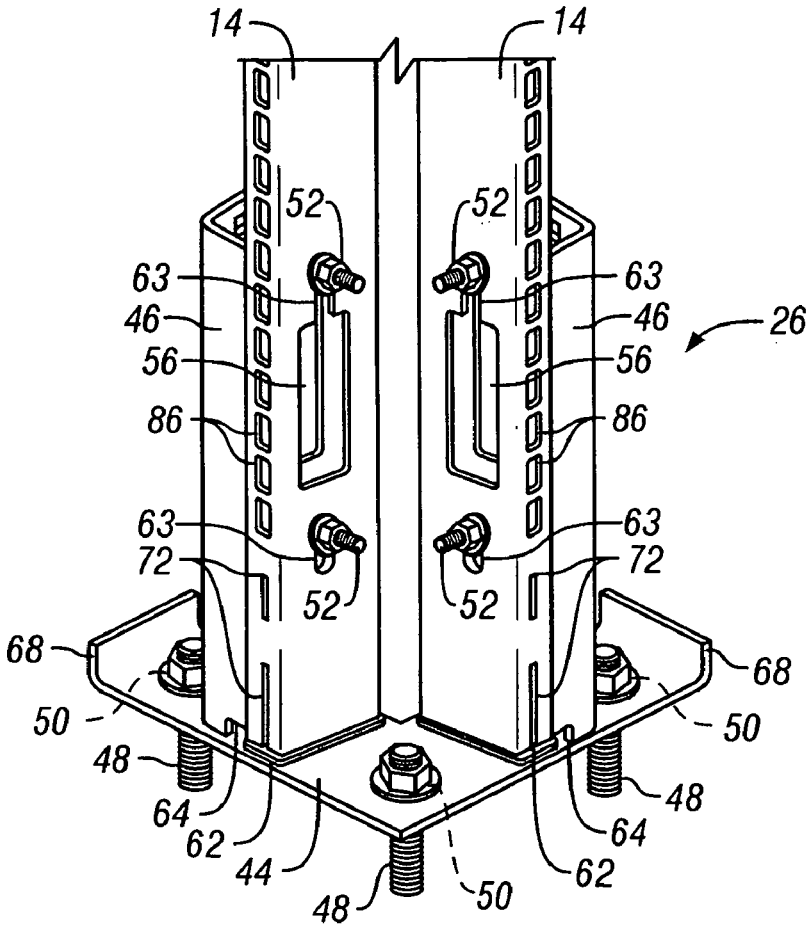
FIG. 13 is an assembled perspective view of the second anchor assembly and two primary uprights illustrated in FIG. 12.

Some types of anchor assemblies 26 are employed to secure only one primary upright 14 as shown in FIGS. 9–11, while others (see FIGS. 12–23) are adapted to secure two or more primary uprights 14 preferably in the same manner or a similar manner as those described above.

Each upright member 46 or set of upright members 46 can be oriented on the base plate 44 in any manner desired. In this way, the anchor assemblies 26 can be adapted to orient the primary uprights 14 in any manner. Examples of different upright member orientations (and therefore, of different primary upright orientations) are illustrated in FIGS. 9–23. In some preferred embodiments of the present invention, various elements and structures can be connected to the primary uprights 14 on fewer than all sides thereof. Accordingly, the orientation of the upright members 46 on the anchor assemblies 26 (and therefore the orientation of the primary uprights 14 connected thereto) at least partially determines the orientation of these various elements and structures when connected to the primary uprights 14. For example, the primary uprights 14 illustrated in FIGS. 9–23 are adapted to be connectable to stretchers 28 on two of the four primary upright sides. Therefore, two or more primary uprights 14 on the same anchor assembly 26 and mounted in different orientations may be needed to connect adjacent walls in a non-parallel fashion. Accordingly, the anchor assemblies 26 of the present invention can each have a single upright member 46, can each have two or more upright members 46 for connection of more than one upright member 46 to a primary upright 14, or can have two or more upright members 46 for securing two or more primary uprights 14 in different locations and/or orientations on the same anchor assembly 26 (whether to enable the connection of walls or other elements of the modular room 10 at different angles with respect to one another or otherwise).

The shape of the base plate 44 can be selected according to the desired positions of one or more upright members 46 on the base plate 44, the location of the anchor assembly 26 with respect to walls or other portions of the room 10, and the function of the anchor assembly 26 as an element of the modular room 10. For example, the base plate 44 can be straight such as those illustrated in FIGS. 9–11, can be angled such as those illustrated in FIGS. 12–23, can be in the shape of a V, T, X, or can take any other shape desired.

With continued reference to FIGS. 9–20, the upright members 46 of the anchor assemblies 26 can be provided with apertures 54 for access to the primary uprights 14 when connected to the anchor assemblies 26. In addition to assisting in the assembly process, these apertures 54 can be used for wiring access into and through the primary uprights 14, such as for distributing electrical wiring, telecommunications lines, or computer cables through the primary uprights 14 and through adjacent walls of the room 10, for cable management, and the like. Preferably, when the primary uprights 14 are connected to the anchor assemblies 26, the apertures 54 are at least partially aligned with one or more apertures 56 in the primary uprights 14 to enable access into and through the primary uprights 14.

The anchor assemblies 26 can be used to support significant loads, such as the weight of walls and fixtures connected to the primary uprights 14. The anchor assemblies 26 are therefore preferably made from a high strength material such as steel, iron, aluminum, or other metal, composites, or high-strength plastic.

To further withstand heavy loading, the anchor assemblies 26 of some preferred embodiments have flanged edges to resist bending moments placed upon the anchor assemblies 26. With reference to FIGS. 9–23 for example, ends of the base plate 44 have upturned flanges 68 which resist bending of the base plate 44 under heavy loads. The flanges 68 can be turned in any manner and to any degree to accomplish this same function, but preferably are not turned to interfere with mounting the base plate 44 upon a surface as described above. In some highly preferred embodiments, the flanges 68 are at approximately a 90° angle with respect to the base plate 44. The flanges 68 can be defined by bent edges of the base plate 44, can be formed with the base plate 44 (such as by being cast, molded, or machined with the base plate 44), or can even be separate elements connected to the base plate 44 by welding, brazing, fasteners, or in any other conventional manner. Different edges of the base plate 44 can be flanged according to the anticipated manner in which loads will be placed upon the anchor assembly 26. Any number of flanges 68 can be located at any or all of the edges of the anchor plate 26.

Figure 24:
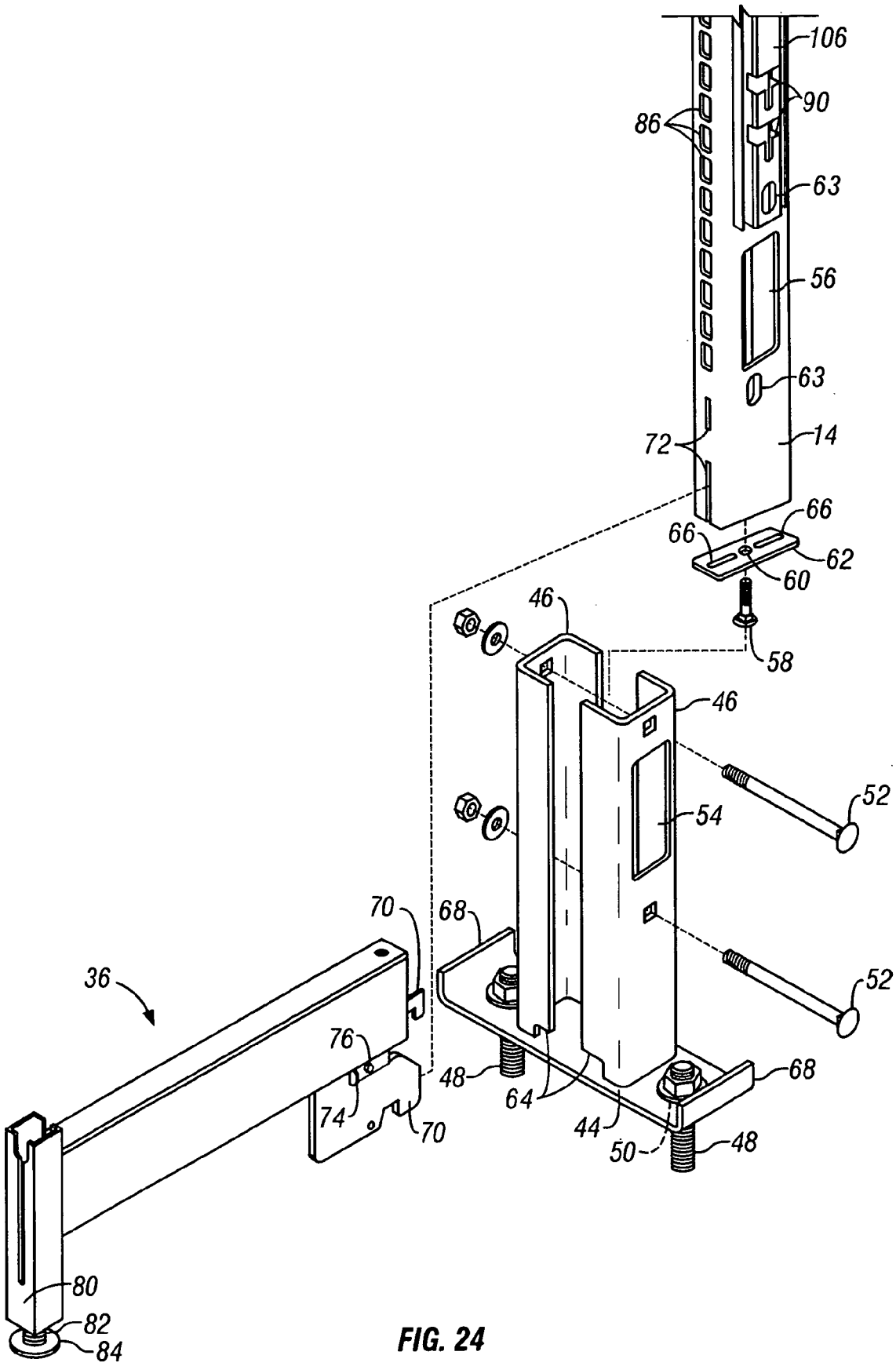
FIG. 24 is an exploded perspective view of the first anchor assembly illustrated in FIG. 9 and a base leg bracket assembly.
Figure 25:
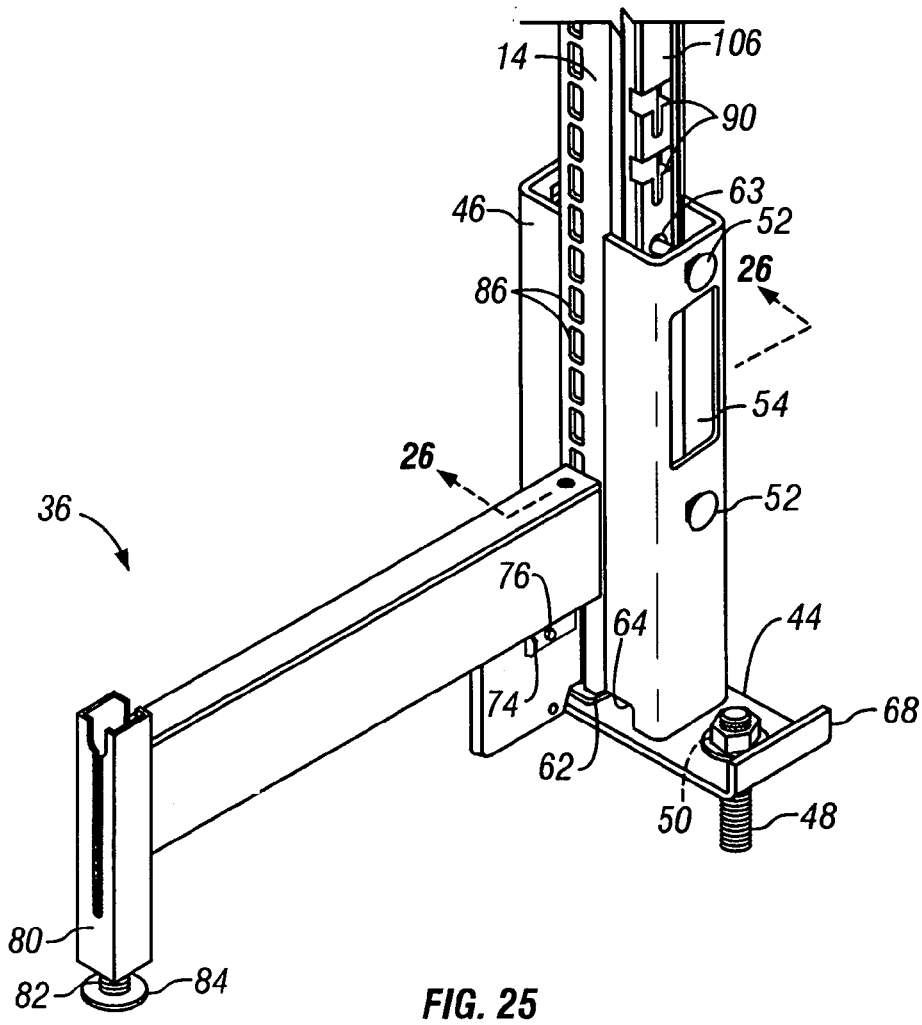
FIG. 25 is an assembled perspective view of the first anchor assembly and base leg bracket assembly illustrated in FIG. 24.
Figure 26:
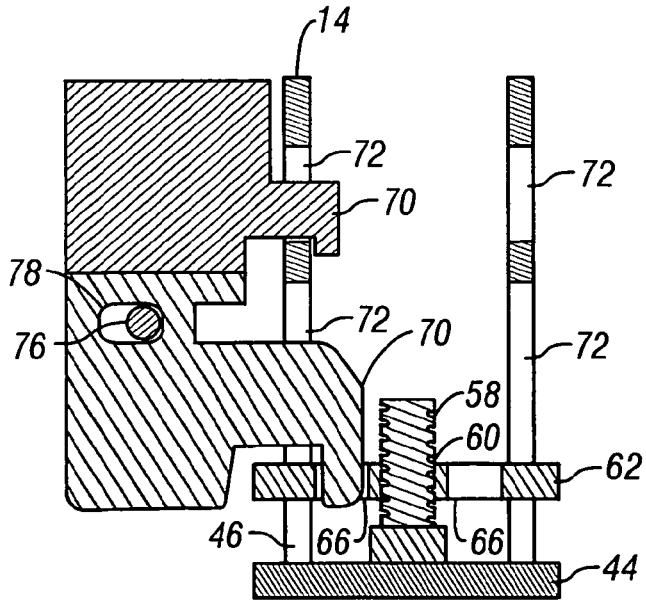
FIG. 26 is a cross-sectional view of the first anchor assembly and base leg bracket assembly illustrated in FIG. 24, taken along lines 26—26 in FIG. 25.

In some preferred embodiments of the present invention, the primary uprights 14 are vertically adjustable in order to level various elements and structures connected thereto (such as wall panels, fixtures, and the like). A preferred manner of performing this function is illustrated in FIGS. 24–26. Specifically, an elevation-adjusting element or a threaded element 58 can be received within a threaded aperture 60 in a bottom plate 62 connected to the bottom of a primary upright 14. The bottom plate 62 can be connected to the primary upright 14 in any conventional manner, including any of the manners of connection described above with reference to the relationship between the base plate 44 and the upright member 46 of the anchor assembly 26. Most preferably however, the bottom plate 62 is connected to the primary upright 14 by welds (not shown). In other embodiments, the bottom plate 62 can even be integral with the primary uprights 14.

The threaded element 58 is preferably a bolt or threaded rod. In other embodiments, the threaded aperture 60 can be defined in an end cap secured in the end of the primary upright 14, a boss or flange extending from an internal wall of the primary upright 14, and the like. By rotating the threaded element 58, the threaded element 58 can raise or lower the primary upright 14 (along with elements and structures connected thereto). In this manner, the end of the threaded element 58 resting upon the base plate 44 acts as a foot for the primary upright 14. The lower ends of the upright members 46 can be recessed (at 64) or can have notches or apertures providing tool access to the threaded element 58 in order to raise or lower the primary upright 14. As the threaded element 58 is turned, an end of the threaded element 58 can press against the floor, the base plate 44 of the anchor assembly 26 as shown in the figures, or against another element beneath the threaded element 58. After the primary upright 14 has been elevated or lowered to a desired height, the fasteners 52 can be used to secure the primary upright 14 in place as described in greater detail above. To this end, apertures 63 in the primary upright 14 through which the fasteners 52 are received can be elongated or can otherwise be shaped to permit the fasteners 52 to move and be secured in different positions with respect to the primary upright 14.

Other elevation-adjusting elements and mechanisms can be used in place of the threaded element 58 and threaded aperture 60 described above. By way of example, the anchor assemblies 26 can each be provided with any type of conventional jack, such as a ratchet jack, a scissor jack, and the like. Still other elevation-adjusting elements and mechanisms are possible, each one of which falls within the spirit and scope of the present invention.

With reference to FIGS. 24–26, the base leg bracket assembly 36 can be employed in some cases where additional strength and/or rigidity of the primary upright 14 and anchor assembly 26 are desired. For example, the primary uprights 14 of the modular room 10 can experience significant lateral forces, such as forces from the weight of elements (e.g., wall panels 12, countertops 20, shelves and fixtures (not shown), and the like) directly or indirectly connected to the primary uprights 14. These forces can generate torque at the connection of the primary uprights 14 to the anchor assemblies 26. To increase the resistance to such torque, some preferred embodiments of the present invention employ one or more brackets attached to the bottom of the primary upright 14 in order to distribute the torque to a location disposed from the primary upright. In the embodiment illustrated in FIG. 24 for example, a bracket assembly 36 is attached to the primary upright 14 as will be described in greater detail below.

A problem encountered with the use of brackets and bracket assemblies 36 is the undesirable forces often exerted upon a face of the primary upright 14 by the bracket or bracket assembly 36 under load. In some cases, the forces are sufficiently strong to cause the face of the primary upright 14 (which is typically capable of bearing significantly more axial load than lateral load) to deform or buckle. The bracket assembly 36 of the present invention addresses this problem by transferring at least some of the force exerted by the bracket assembly 36 upon the primary upright 14 to an element within or at the end of the primary upright 14, thereby changing lateral forces upon the primary upright 14 to axial forces upon the primary upright 14. More precisely, the resulting forces are a combination of axial and lateral forces exerted upon the end of the primary upright 14. For purposes of identification however, the term "axial" will be used hereinafter to refer to the direction of such resulting forces.

In some embodiments of the present invention, the bracket assembly 36 is attached to the bottom plate 62 at the end of and/or attached to the primary upright 14 as described above. In the illustrated embodiments, the bottom plate 62 includes elongated apertures 66 within which the bracket assembly 36 can be received to connect the bracket assembly 36 to the bottom plate 62.

The base leg bracket assembly 36 preferably has one or more connection fingers 70 which can be inserted into apertures 72 in the primary upright 14. In the illustrated preferred embodiment, the base leg bracket assembly 36 has two such fingers 70. Although the fingers 70 can take any shape capable of being received within the apertures 72, the fingers 70 are preferably downturned to permit the leg bracket assembly 36 to be inserted into the primary upright 14 and then pushed down into place as best shown in FIG. 26.

In the illustrated preferred embodiment, the lower finger 70 inserts into the elongated aperture 66 in the bottom plate 62. Thereafter, when torque is applied to the primary upright 14 by the off-center weight of elements connected to the primary upright 14 or from forces exerted upon such elements and/or the primary upright 14, torque is preferably transferred from the primary upright 14 to the base leg bracket assembly 36 and through the bottom plate 62 rather than exclusively upon a side face (or other surface that contacts the base leg bracket assembly 36) of the primary upright 14. In other words, when torque is applied to the primary upright 14 as described above, the lower finger 70 of the bracket assembly 36 preferably engages the bottom plate 62 and pulls upward or pushes downward on the bottom plate 62 (depending on which direction the torque is applied). Transferring torque to the base leg bracket assembly 36 via the bottom plate 62 can decrease the amount of horizontal force applied to the primary upright 14 by the bracket assembly 36.

The bracket assembly in the illustrated preferred embodiment is attached to the bottom plate 62 by extending into the primary upright 14 and through an aperture 66 in the bottom plate 62. Although this bracket assembly structure is preferred, it should be noted that a number of other bracket assembly shapes and structures can be employed to perform the same function. Specifically, any part of the bracket assembly 36 can extend to and connect with the bottom plate in any desired manner. By way of example only, a threaded fastener on the end of the bracket can be received within an aperture in the bottom plate 62 and can be secured in place therein with a nut. As another example, the bottom plate 62 can have a finger, hook, apertured plate, or other extension received within the end of the primary upright 14 for connection therein to fingers, hooks, conventional fasteners, or other elements on the bracket assembly 36. Still other manners of connecting the bracket assembly 36 to the bottom plate 62 are possible and fall within the spirit and scope of the present invention.

It should also be noted that the bracket assembly 36 need not necessarily connect to a bottom plate 62 as described above in order to perform the function of exerting axially-directed force upon the primary upright 14. The bracket assembly 36 can connect to a number of other structures and elements on the primary upright 14 to perform this function. By way of example only, the bracket assembly 36 can engage a post, pin, rod, fastener shank, or other element within the primary upright 14 and extending across the interior of the primary upright 14, can be received within an aperture of a plate or other element secured inside the primary upright 14 in any conventional manner, and the like. Such other elements to which the bracket assembly 36 can be connected also fall within the spirit and scope of the present invention.

In some preferred embodiments of the present invention, the leg bracket assembly 36 has a locking element 74 attached thereto which can be pushed into an aperture in the primary upright 14 (such as one of the apertures 72 for the fingers 70 of the bracket assembly 36) in order to prevent the leg bracket assembly 36 from being lifted within the apertures 72 in the primary upright 14. In the illustrated preferred embodiment, the locking element 74 is a slide connected to the leg bracket assembly 36 by a pin 76 slidably received within an elongated aperture 78 (see FIG. 26) in the leg bracket assembly 36. By pushing the locking element 74 toward the primary upright 14 and into the aperture 72 in the primary upright 14, the locking element 74 occupies the aperture 72 above the lower finger 70, thereby preventing removal of the lower finger 70 without retraction of the locking element 74 from the aperture 72. One having ordinary skill in the art will appreciate that other elements and devices can be used to prevent the fingers 70 of the leg bracket assembly 36 from lifting in their respective apertures 72 following installation of the leg bracket assembly 36.

The leg bracket assembly 36 also preferably has a leg 80 which rests upon the ground or floor adjacent to the primary upright 14. In this manner, the leg 80 preferably carries some forces away from the primary upright 14 and anchor assembly 26, thereby reducing the amount of torque upon the anchor assembly 26 and bottom end of the primary upright 14.

The finger and aperture connection of the leg bracket assembly 36 is only one preferred manner of connecting the leg bracket assembly 36 to the primary upright 14. In other embodiments of the present invention, the leg bracket assembly 36 can be connected to the primary upright 14 by one or more fasteners (such as threaded fasteners, rivets, clamps, and the like), by welding the leg bracket assembly 36 to the primary upright 14 or in any other conventional manner. Most preferably, the leg bracket assembly 36 is removable from the primary upright 14 as shown in the figures.

With continued reference to FIGS. 24–26, the leg 80 of the leg bracket assembly 36 is adjustable in some embodiments in order to level the leg bracket assembly 36 and the elements and structures connected thereto. Preferably, this adjustability is enabled by a threaded rod 82 connected to a foot 84 of the leg bracket assembly 36. By turning the threaded rod 82 and/or foot 84, the threaded rod 82 preferably threads into or out of a threaded aperture in the leg 80 and thereby adjusts the level of the leg bracket assembly 36. Like the threaded element 58 and threaded aperture 60 assembly for the primary uprights 14 described above, several alternative elevation-adjusting elements and devices exist which can instead be used to level the leg bracket assembly 36. By way of example, the leg bracket assembly 36 can be provided with any type of conventional jack, such as a ratchet jack, a scissor jack, and the like, can be secured in place with respect to a telescoping post or tube within the leg 80 by a pin received within mating apertures in the leg 80 and telescoping post or tube, and the like.

Referring back to FIGS. 2–20, the primary uprights 14 are preferably tubular elements having multiple apertures 86 along at least part of their length. These tubular elements can have any cross-sectional shape (including without limitation, rectangular, square, triangular, round, oval, and irregular shapes), but most preferably are rectangular as shown in the figures. The apertures 86 preferably enable many different types of structural components and fixtures to be connected to the vertical uprights 14 in multiple locations and in different adjustable configurations along the length thereof. For greater adjustability, the primary uprights 14 can have several apertures 86 located closely together along at least a portion of the length of the primary uprights 14. Although the apertures 86 can run along any length of the primary uprights 14, the apertures 86 preferably run the entire length or nearly the entire length of the primary uprights 14. Most preferably, a large number of apertures 86 running along most or all of the primary uprights 14 are used to permit attachment of different types of structural components and fixtures in a large number of locations and at a wide range of heights along the primary uprights 14. If less adjustability is desired, fewer apertures 86 can be used. Similarly, if connection of different types of structural components and fixtures to only a portion of the primary upright 14 is desired, the apertures 86 can be located on only one or more parts of the primary upright 14.

The apertures 86 are preferably rectangularly shaped as shown in the figures. However, the apertures 86 can instead take any other shape desired, including without limitation, square, triangular, key, oval, round, and irregular shapes.

A valuable feature of the present invention is the ability to attach a number of different structural components and fixtures (hereinafter collectively referred to as "fixtures") to the primary uprights 14. With reference for example to FIGS. 1, 2, 4–8 and 27, fixtures can include wall panels 12, doors 16, pass-thrus 18, countertops 20, windows 22, soffits 24, privacy panels 25, mop boards 30, base leg bracket assemblies 36, and kick plates 38. As will be described in greater detail below, the primary uprights 14 therefore perform the functions of bearing the loads of walls, windows, conduits, trusses, and other structural components of the room as well as supporting the fixtures used for outfitting the room for its particular purpose, such as, for example, use as a pharmacy. Thus, an important feature of the present invention is the ability of the primary uprights 14 to serve several different functions.

Figure 27:
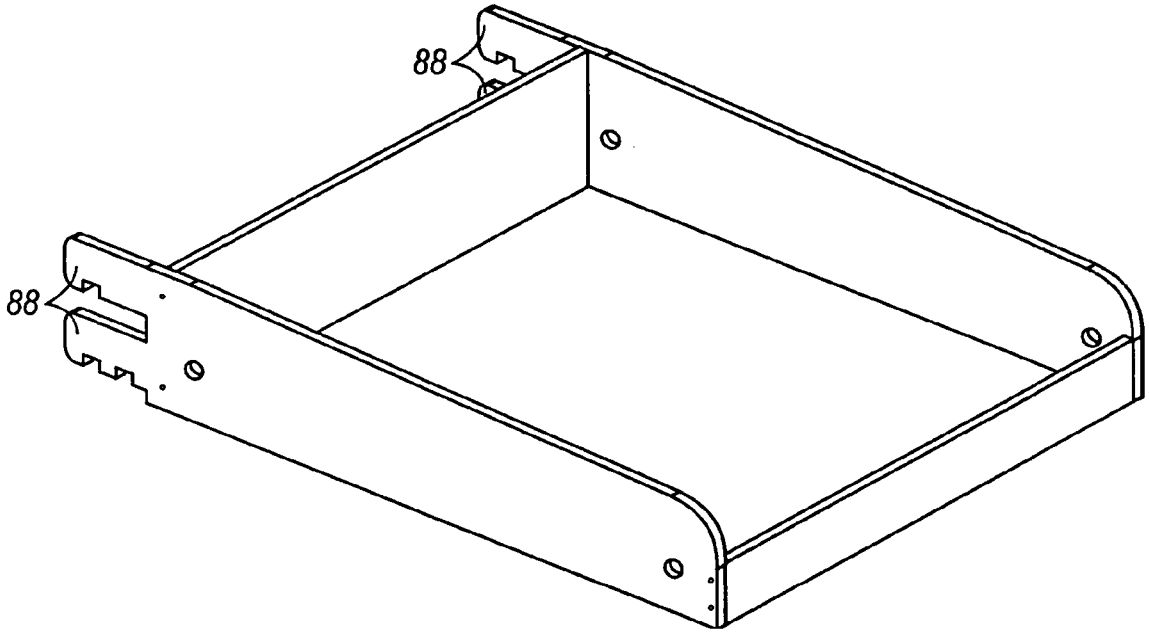
FIG. 27 is a perspective view of a fixture mountable within the modular room of FIG. 1.

Preferably, apertures 86 are located on portions of the primary uprights 14 facing the inside or the outside of the modular room 10. In the case of primary uprights 14 having rectangular cross sections as illustrated in the figures, the apertures 86 can be located on opposite sides of the primary uprights 14. To connect a fixture or other element to the apertures 86 on a primary upright 14, the fixture or other element preferably has one or more fingers 88 that are received within the apertures 86. An example of such fingers 88 is illustrated in FIG. 27, which shows part of a shelf unit that can be mounted to two primary uprights 14. Preferably, the fingers 88 are curved, downturned, notched, or otherwise interconnect within the apertures 86 when installed therein. In this manner, the fingers 88 can be securely installed in the apertures 86.

It should be noted that a number of alternatives exist by which fixtures or other elements can be connected to the primary uprights 14. For example, such fixtures or other elements can be connected by fasteners threaded into apertures in the primary uprights 14, by slots within which are received pins, posts, fingers or other elements as described in greater detail below with regard to lateral connectors 90 of the primary uprights 14, and the like.

Figure 28:
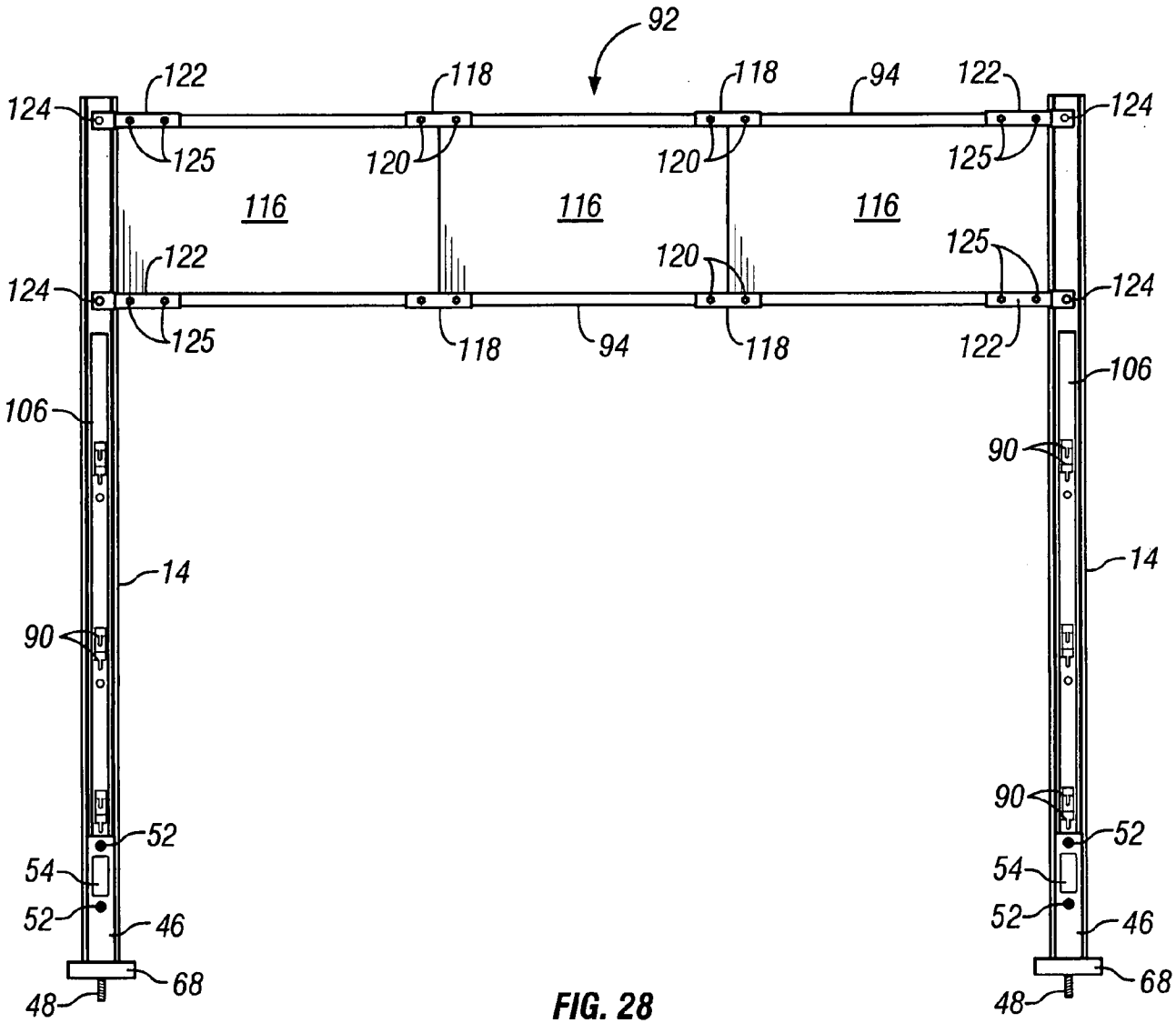
FIG. 28 is a side view of a portion of the modular room illustrated in FIG. 1, showing a truss assembly of the modular room attached to front and rear primary uprights.
Figure 29:
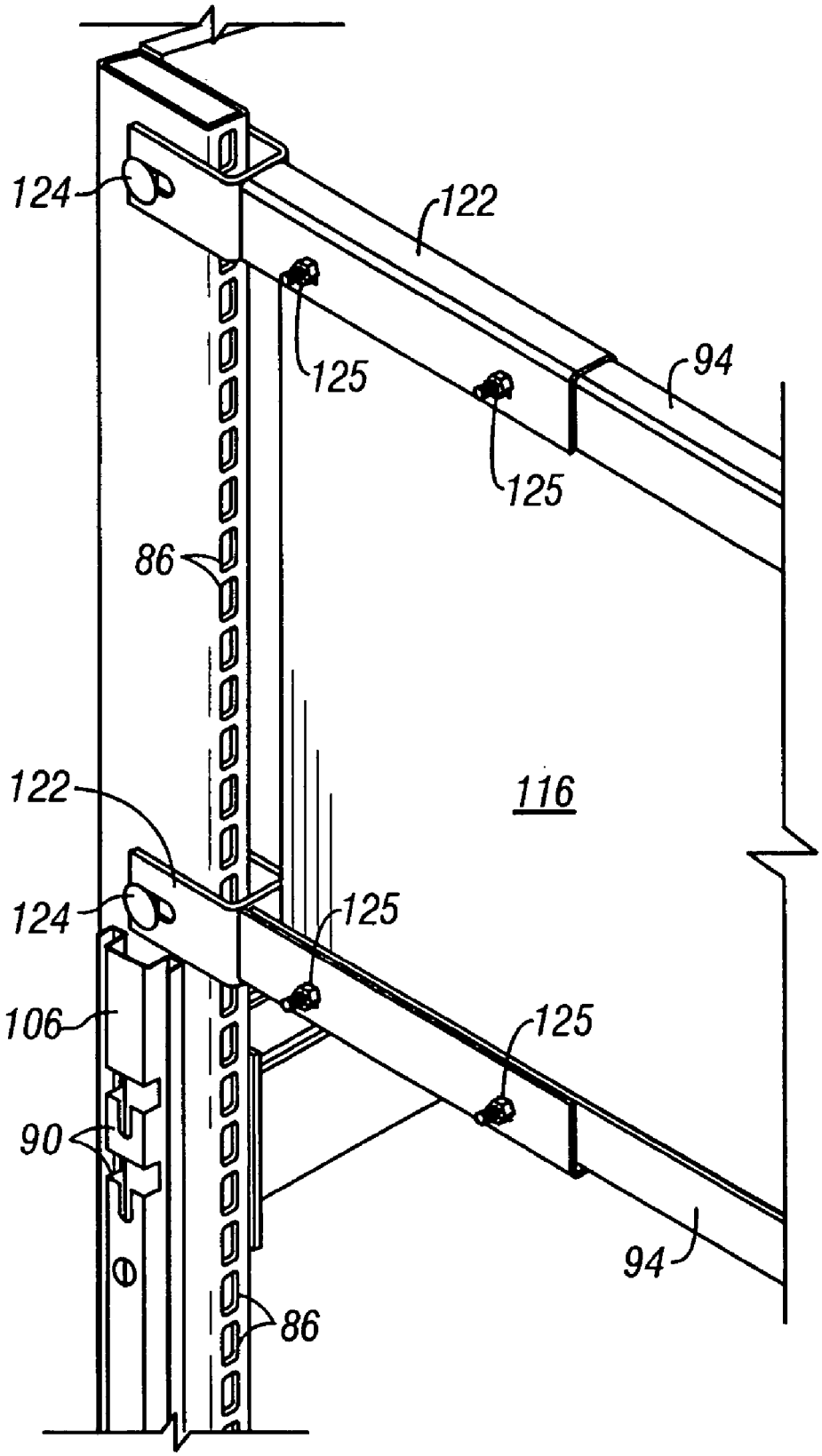
FIG. 29 is a perspective view of an end of the truss assembly illustrated in FIG. 28.
Figure 30:
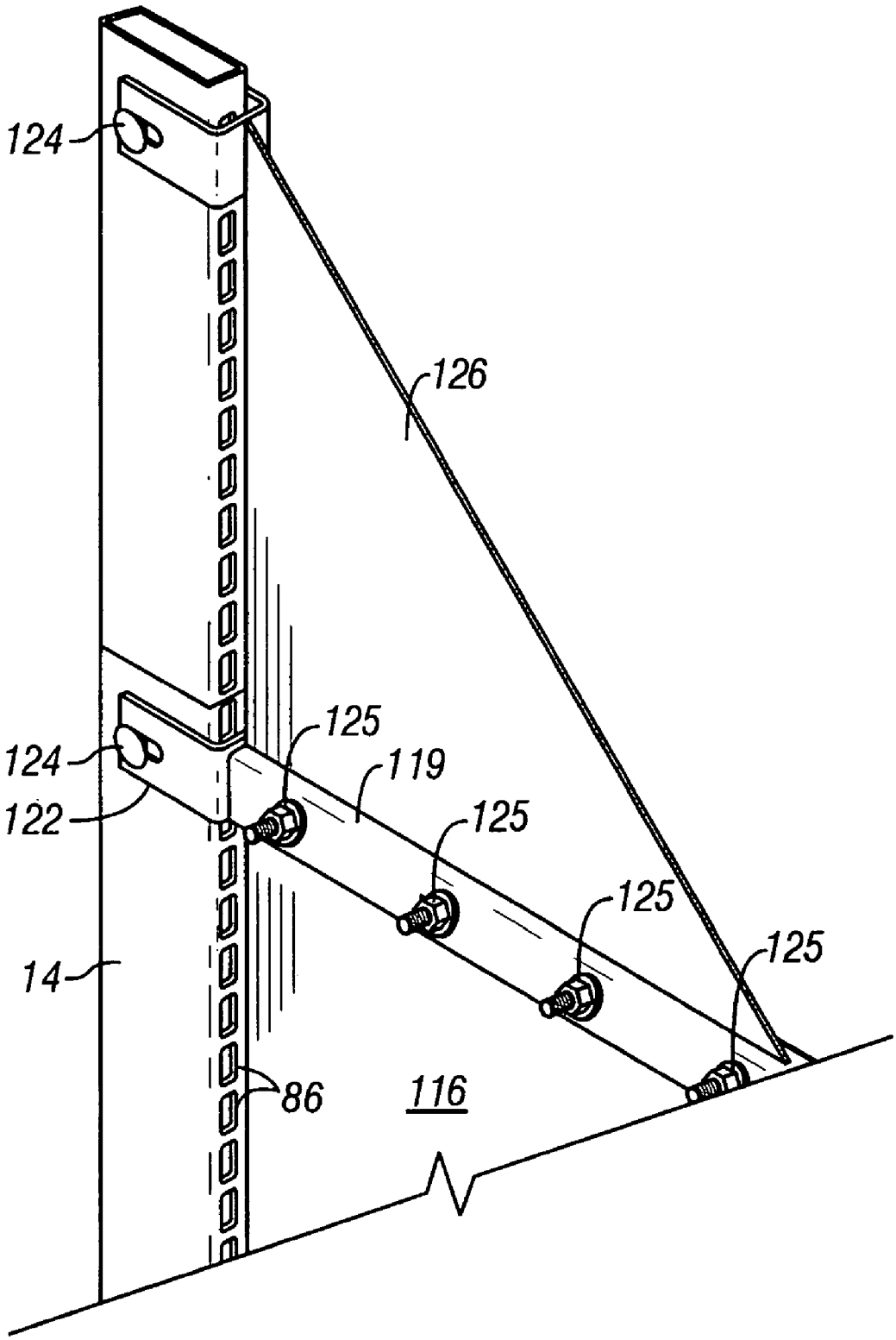
FIG. 30 is perspective view of a truss clevis of the modular room.

With reference to FIGS. 28–30, the primary uprights 14 also preferably provide support for the overhead structure of the modular room 10, including the ceiling. Specifically, overhead trusses 92, beams 94, and other elements can be connected to the primary uprights 14 to support the ceiling and to keep the uprights 14 in proper orientation relative to one another.

Accordingly, an important function of the primary uprights 14 is to support the walls and overhead structure of the modular room 10. However, as described above, the primary uprights 14 are also adapted to permit attachment of fixtures thereto. These fixtures can have an auxiliary load-bearing or structural purpose, but normally perform no function to support the room (or the framework thereof). The use of the same structural members to perform both functions saves space and manufacturing and assembly costs, results in a simpler room design and rapid assembly, and increases the modularity of the room 10 (enabling greater flexibility in the location of fixtures, the height and relative spacing thereof, etc.). For example, by using shelving, cabinets, countertops, workstations, or other elements or assemblies that can be attached at any height to two adjacent primary uprights 14 in the modular room 10 or to stretchers 28 attached to the primary uprights 14, elements that would otherwise be needed for assembling the shelving are eliminated, such as shelf mounting assemblies, frames, and stands. Also, the shelves can be moved from location to location within the modular room 10 as needed without the need for additional structure to position and mount the shelves. All the structure that is needed already exists in the primary uprights 14. As can be appreciated, such ease in being able to adjust and readjust the configuration of the fixtures as may be required for any particular purpose or setting, without the need for additional structural or support members, contributes to the invention's wide utility.

Another advantage of employing primary uprights 14 to position and mount fixtures is related to the position of the primary uprights 14 in the modular room structure. In particular, the primary uprights 14 are preferably accessible from both sides of the wall in which the primary uprights 14 are located. The primary uprights 14 preferably have apertures 86 that face into the modular room 10 and apertures 86 that face the environment outside of the modular room 10. Therefore, fixtures such as shelves, media displays, racks, and the like can be mounted to the exterior of the modular room 10 using the same primary uprights 14 to which are secured interior room fixtures and room structural framework as described above.

The primary uprights 14 are preferably also provided with lateral connectors 90 for connecting adjacent primary uprights 14 as described in greater detail below and for lateral connection of other elements and assemblies to the primary uprights 14. The lateral connectors 90 can also be apertures in the primary uprights 14 in which elements and assemblies can be connected, or can take the form of other connector types which mate with such elements and assemblies.

Figure 4:
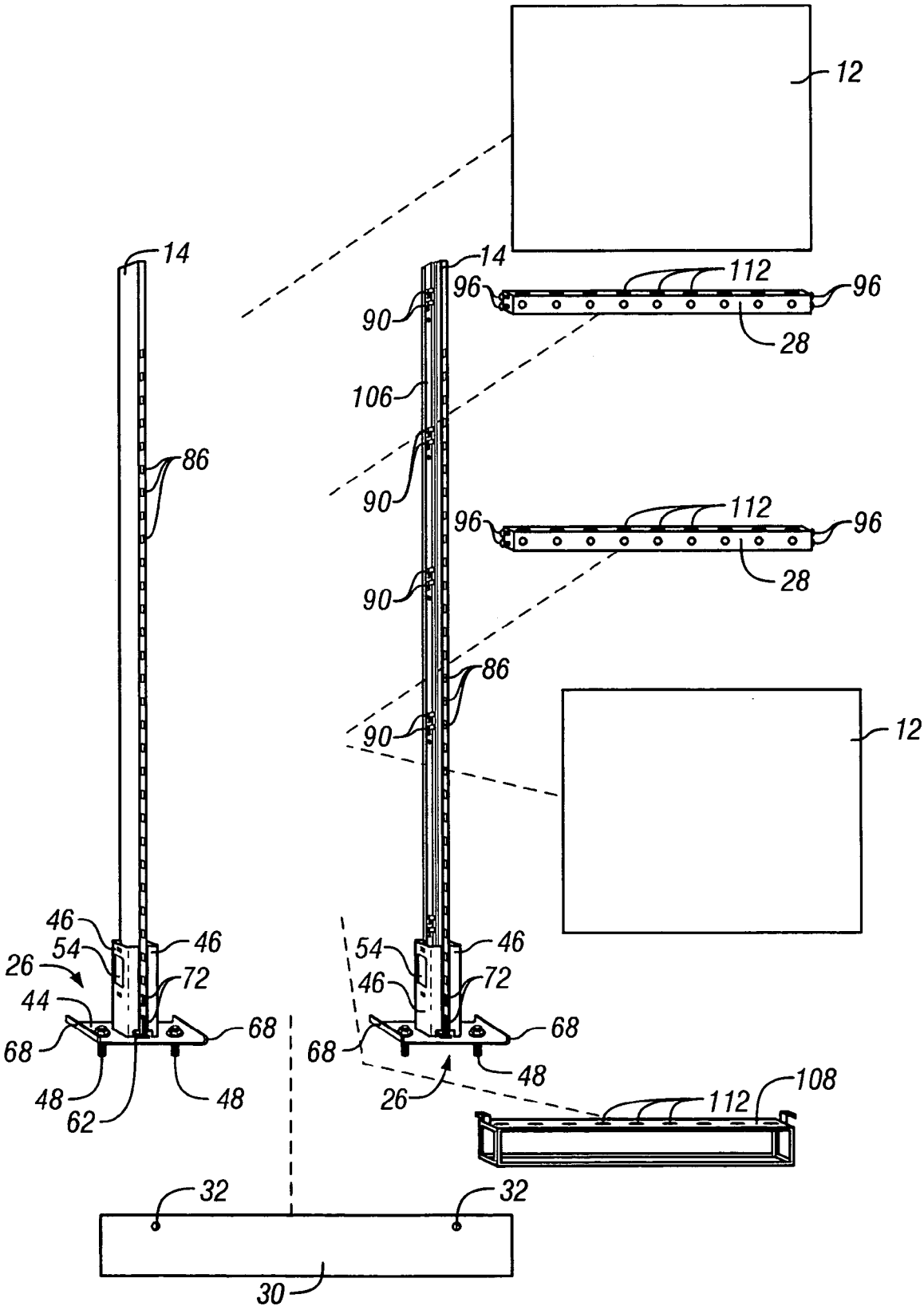
FIG. 4 is an exploded front view of a portion of the modular room illustrated in FIG. 1.
Figure 7:
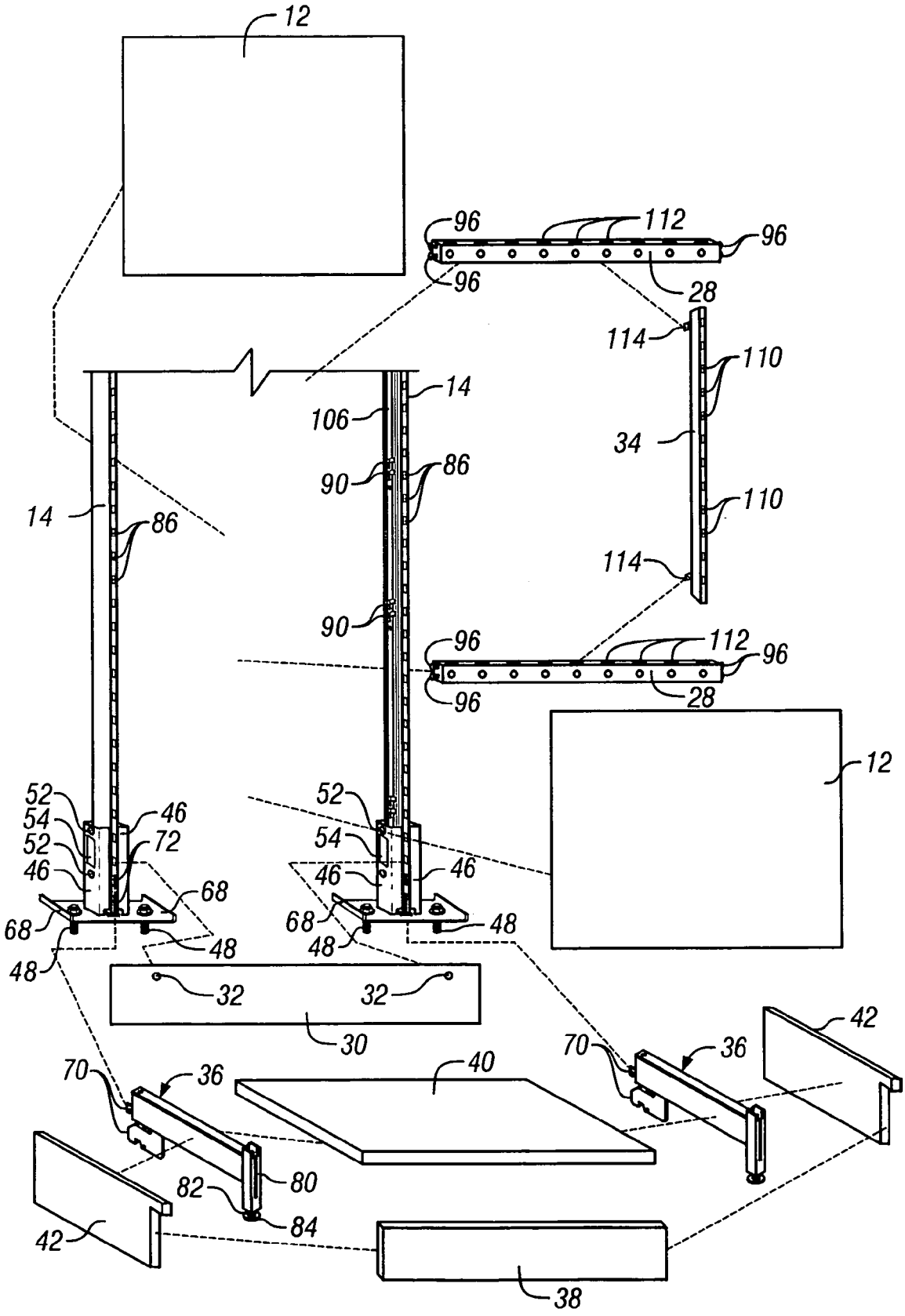
FIG. 7 is an exploded view of another portion of the modular room illustrated in FIG. 1, viewed from the inside of the modular room.

Two examples of lateral connector types are illustrated in the figures by way of example. The first type of lateral connector 90 is best shown in FIGS. 9–11, 14–20, 24, 25 and 29 and is a slot within which pins, posts, fingers, or other elements are received for connection to the primary uprights 14. In the illustrated preferred embodiments, the elements which connect with the lateral connectors 90 are headed posts 96 as shown in FIGS. 4 and 7. An element having such headed posts 96 is connected with the lateral connectors 90 by sliding the posts 96 into the slots defined therein. After the headed posts 96 or other elements are located in position in the slots of the lateral connectors 90, a threaded fastener can be tightened to secure the element or assembly in place with respect to the lateral connector 90. Alternatives to threaded fasteners are possible, and include rivets, pins passed through holes in the element or assembly and the lateral connector 90 or primary upright 14, and the like. Although upwardly-opening lateral connector slots are preferred as shown in the figures, it should be noted that slots having other orientations are possible.

Figure 32:
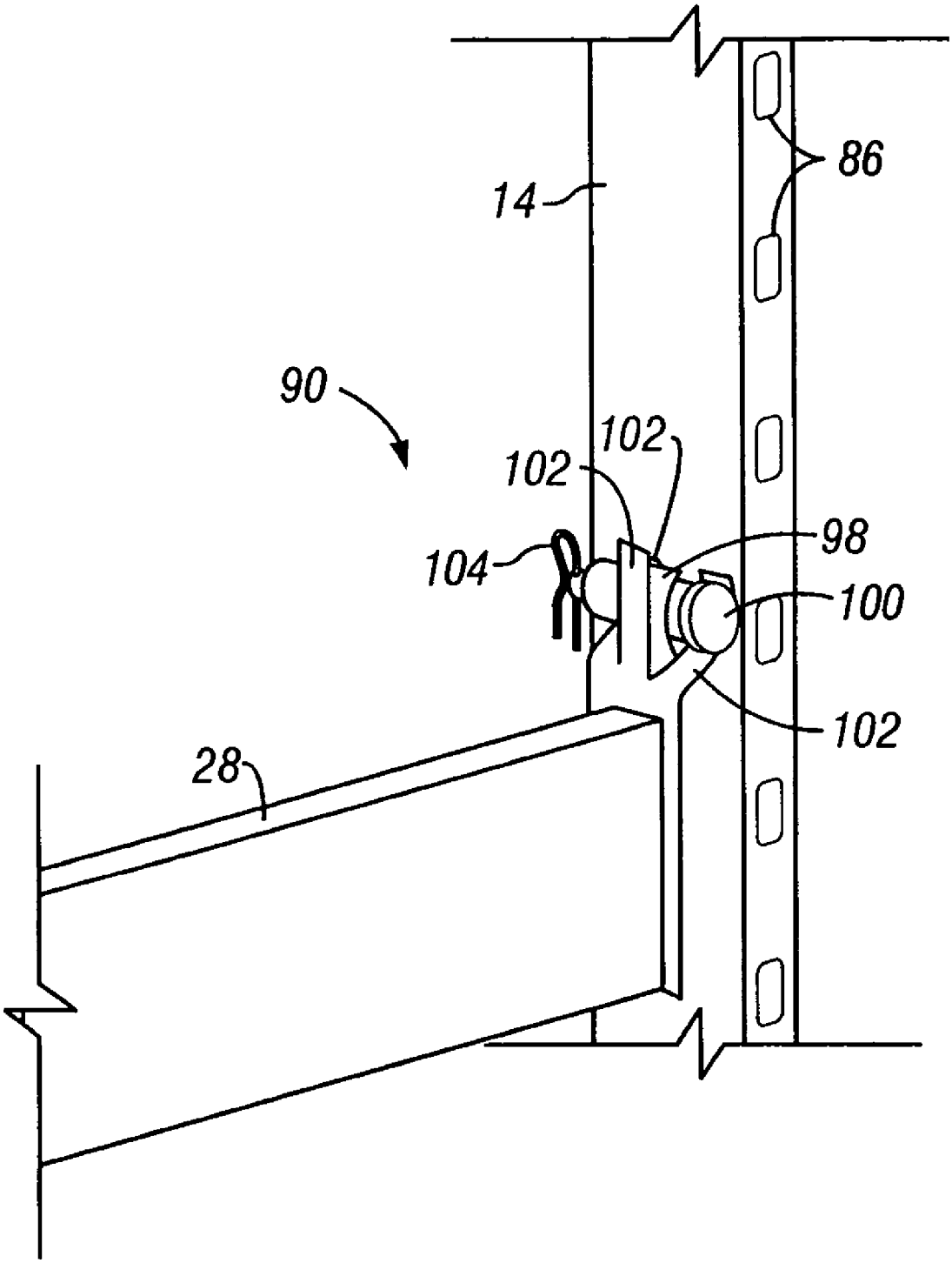
FIG. 32 is a perspective view of an alternative stretcher-to-primary upright connection according to the present invention.

Another type of lateral connector 90 is illustrated in FIG. 32. In this embodiment, the lateral connector is defined by one or more tongues 98 which are integral with or connected to the primary uprights 14 and which are shaped to receive a pin, bolt, or other fastener 100 between the tongue 98 and the primary upright 14. One or more tongues 102 on the element or assembly to be connected to the primary uprights 14 are also shaped to receive the pin, bolt, or other fastener 100, thereby trapping the fastener 100 between the tongues 98 of the primary upright 14 and the tongues 102 of the element or assembly connected thereto. If desired, the pin, bolt, or other fastener 100 can be secured between the tongues 98, 102 with a pin 104. Like the slot-type lateral connector described above, the tongues 98, 102 can take any relative orientation desired. In addition, any number of tongues 98, 102 can exist for each lateral connector 90.

Other types of lateral connectors 90 can be employed to laterally connect an element or assembly to a primary upright 14. By way of example only, the lateral connectors 90 can be a plurality of apertures in the primary uprights 14 into which fingers on the element or assembly can extend in a manner similar to the apertures 86 described above. Still other types of lateral connectors 90 are possible and fall within the spirit and scope of the present invention.

The lateral connectors 90 of the present invention can be defined in the primary uprights 14, such as by one or more apertures located in the lateral walls of the primary uprights 14 or elements cut, bent, or otherwise formed from the lateral walls of the primary uprights 14. Alternatively, the lateral connectors 90 can be defined by individual elements connected to the primary uprights 14 in any conventional manner (such as by one or more conventional fasteners, by welding, clamps, and the like). In still other embodiments, the lateral connectors 90 can be defined in or connected to another element which itself is connected to the primary uprights 14 in any conventional manner (including those just mentioned). This latter alternative is employed in many of the illustrated preferred embodiments of the present invention, and is best shown in FIGS. 9–11, 14–20, 24, 25 and 29. More specifically, the lateral connectors 90 in the illustrated preferred embodiments are preferably defined in rails 106 attached to the primary uprights 14. The use of rails 106 is preferred because the rails 106 act to strengthen and increase the rigidity of the primary uprights 14.

Any number of lateral connectors 90 can be used for each primary upright 14. An advantage of using multiple lateral connectors 90 for each rail 106 is that elements and assemblies can be connected laterally to the primary uprights 14 at multiple locations corresponding to different heights along the primary uprights 14. Such an arrangement permits a great amount of flexibility in assembling different room and fixture configurations, contributing to the modularity of the invention and its adaptability to many different environments. In addition, the lateral connectors 90 can act as backing for external wall panels and retainers for interior wall panels.

Another advantage of using a rail-type structure for the lateral connectors 90 is that the rail 106 can be shaped and dimensioned to cooperate with an upright member 46 of the anchor assembly 26 in order to further stabilize the upright member 46 against movement with respect to the anchor assembly 26 and to provide a more secure connection of the primary upright 46 to the anchor assembly 26. In other words, the rail 106 in some embodiments is received within, mates, engages, or inter-engages with, or otherwise cooperates with the upright member 46 of the anchor assembly 26. Preferably, the rail 106 prevents or limits movement of the primary upright 14 with respect to the upright member 46 (and therefore, the anchor assembly 26) in one or more directions.

By way of example only, the rail 106 in the illustrated preferred embodiments is positioned between the two ends of a C-shaped upright member 46. The two ends prevent the rail 106 and, therefore, the primary upright 14 from moving laterally with respect to the C-shaped upright member 46. Also, the C-shaped upright member 46 and the fasteners 52 prevent the primary upright 14 from moving vertically (due to the primary upright 14 being fastened to the upright member 46) and toward and away from the C-shaped upright member 46 (also due to the primary upright being fastened to the upright member).

Other elements that function in much the same way as the C-shaped upright members 46 can also or instead be used to prevent the primary upright 14 from moving in all three dimensional directions. For example, a rail 106 can be received between the webs of an I-shaped upright member 46 to prevent lateral movement of the rail 106 and primary upright 14. As another example, the rail 106 can have one or more longitudinal recesses, each of which receives an edge of an upright member 46 or a side of the upright member for the same purpose. In short, the rail 106 in many preferred embodiments is shaped to receive or be received within at least part of an upright member 46 in order to further limit movement of the rail 106 (and therefore, the primary upright 14) with respect to the upright member 46. Any cooperating shapes of the rail 106 and upright member 46 can be employed and fall within the spirit and scope of the present invention.

Although the upright members 46 of the anchor assemblies 26 preferably receive or are received within rails 106 attached to or integral with the primary uprights 14 as described above, such elements on the upright members 46 do not necessarily need to be rails 106. In some embodiments, the rails 106 are much shorter, and run only part of the length of the primary uprights 14 or are located on only a small portion of the primary uprights 14 (such as at the bottom ends of the primary uprights 14 for engagement with the upright members 46 of the anchor assemblies 26 as also described above). In other embodiments, the primary uprights 46 can receive or be received within other elements or structure on the primary uprights 14, such as a lateral extension of the primary uprights 14, a fixture attached to the bottom of the primary uprights 14 and engagable with an upright member 46, and the like. However, rails 106 such as those described above are preferred for their dual purpose: providing or defining lateral connectors 90 to which elements and structure can be attached (for securing such elements and structure to a primary upright 14) and providing structure on the bottom end of a primary upright 14 for engagement with an upright member 46.

With reference again to FIGS. 2, 4, and 7, the primary uprights 14 of the modular room 10 can be connected together by a number of different elements, collectively referred to herein as "stretchers" 28. The stretchers 28 function to support the primary uprights 14, and as a skeleton upon which the fixtures and wall panels of the modular room 10 can be attached. In some preferred embodiments such as the illustrated preferred embodiments, threaded fasteners (not shown) are passed through countersunk apertures in wall panels 12 and into apertures in the stretchers 28 to attach the wall panels 12 to the stretchers 28. Other means of attaching wall panels 12 to the stretchers 28 and/or directly to the primary uprights 14 exist, each of which falls within the spirit and scope of the present invention.

Figure 5:
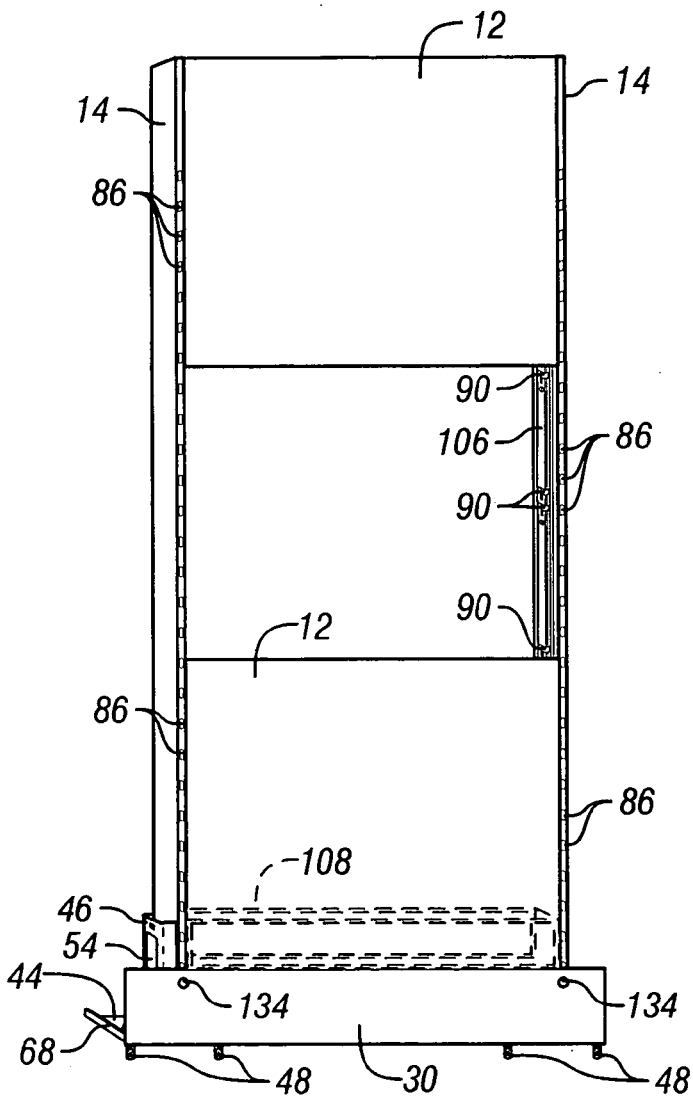
FIG. 5 is an assembled front view of the portion of the modular room illustrated in FIG. 4.
Figure 6:
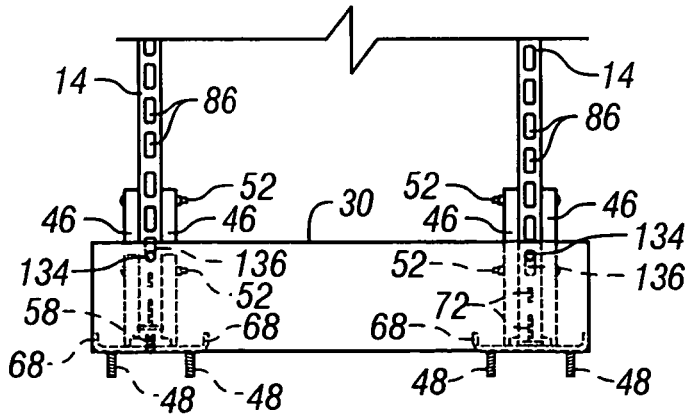
FIG. 6 is a detail view of the portion of the modular room illustrated in FIG. 5, viewed from the outside of the modular room.

The stretchers 28 can also help define an electrical enclosure within the walls of the modular room 10. This type of stretcher 108 is best shown in FIGS. 4 and 5, and preferably includes an area therein that can be used for routing electrical lines, telecommunications wiring, and even plumbing if desired. To this end, the stretcher 108 can be a frame structure without sides for easy access from all areas around the stretcher 108, can have one or more exposed sides and one or more covered sides for more limited access to the interior of the stretcher 108, or can be enclosed with the exception of the stretcher ends 108.

Figure 8:
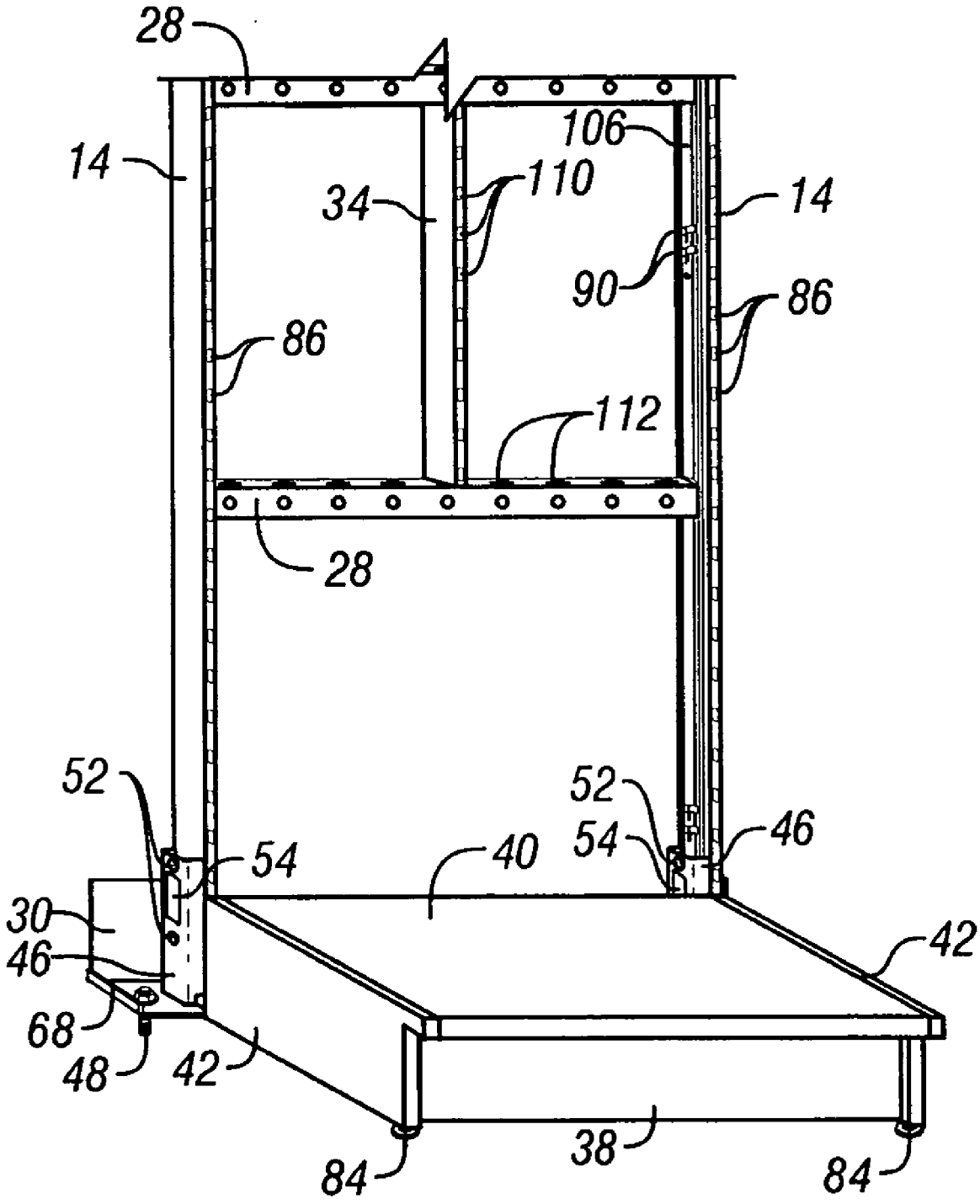
FIG. 8 is an assembled perspective view of the portion of the modular room illustrated in FIG. 7.

For additional flexibility to position and mount fixtures within the modular room 10, secondary uprights 34 can be connected to the stretchers 28 (see FIGS. 7 and 8). In some embodiments, the secondary uprights 34 have apertures 110 that are the same or similar to the apertures 86 in the primary uprights 14. Therefore, fixtures and other elements can preferably be positioned and mounted upon the secondary uprights 34 in the same manner as they are upon the primary uprights 14. The secondary uprights 34 can be connected to upper and/or lower stretchers 28 in any manner desired, such as by inter-engaging elements, conventional fasteners, welding, adhesive or cohesive bonding material, and the like. For example, in some preferred embodiments such as those shown in the figures, some or all of the stretchers 28 have apertures 112 in which fingers, posts, or other elements 114 extending from the secondary uprights 34 can be received. The fingers, posts, or other elements 114 can be attached to the secondary uprights 34 with conventional fasteners, can be welded or brazed thereto, or can even be integral with the secondary uprights 34. Most preferably, the apertures 112 of the stretchers 28 are located in a number of positions along the stretchers 28 to permit the secondary uprights 34 to be laterally positioned as desired. This enables fixtures of different dimensions to be positioned and mounted to the primary 14 and/or secondary uprights 34.

Overhead structure of the modular room 10 can be employed to further strengthen and stabilize the modular room 10. A preferred overhead structural system is illustrated in FIGS. 28–30. A primary component of this system is the truss 92 preferably sufficiently long to span across the modular room 10. The solid truss 92 is preferably sufficiently strong and stiff to span this distance while imparting as little weight as possible upon the primary uprights 14. To this end, the preferred truss structure of the present invention is composite, and includes panels 116 with beams 94 running along and connected to the panel edges. The beams 94 can take the form of C-shaped channels. In some embodiments such as the illustrated preferred embodiments, the panels 116 are made of wood, and more preferably are made of plywood sheeting, while the beams 94 are made of a relatively strong, resilient, and stiff material such as aluminum, steel, iron, or other metal. Alternatively, the panels 116 could be made from plastic, composite sheeting, particleboard, or any other preferably relatively lightweight sheeting capable of withstanding end loading. Although metal beams are preferred, the beams 94 could instead be made from high-strength plastic, fiberglass, composites, and the like.

Figure 31:
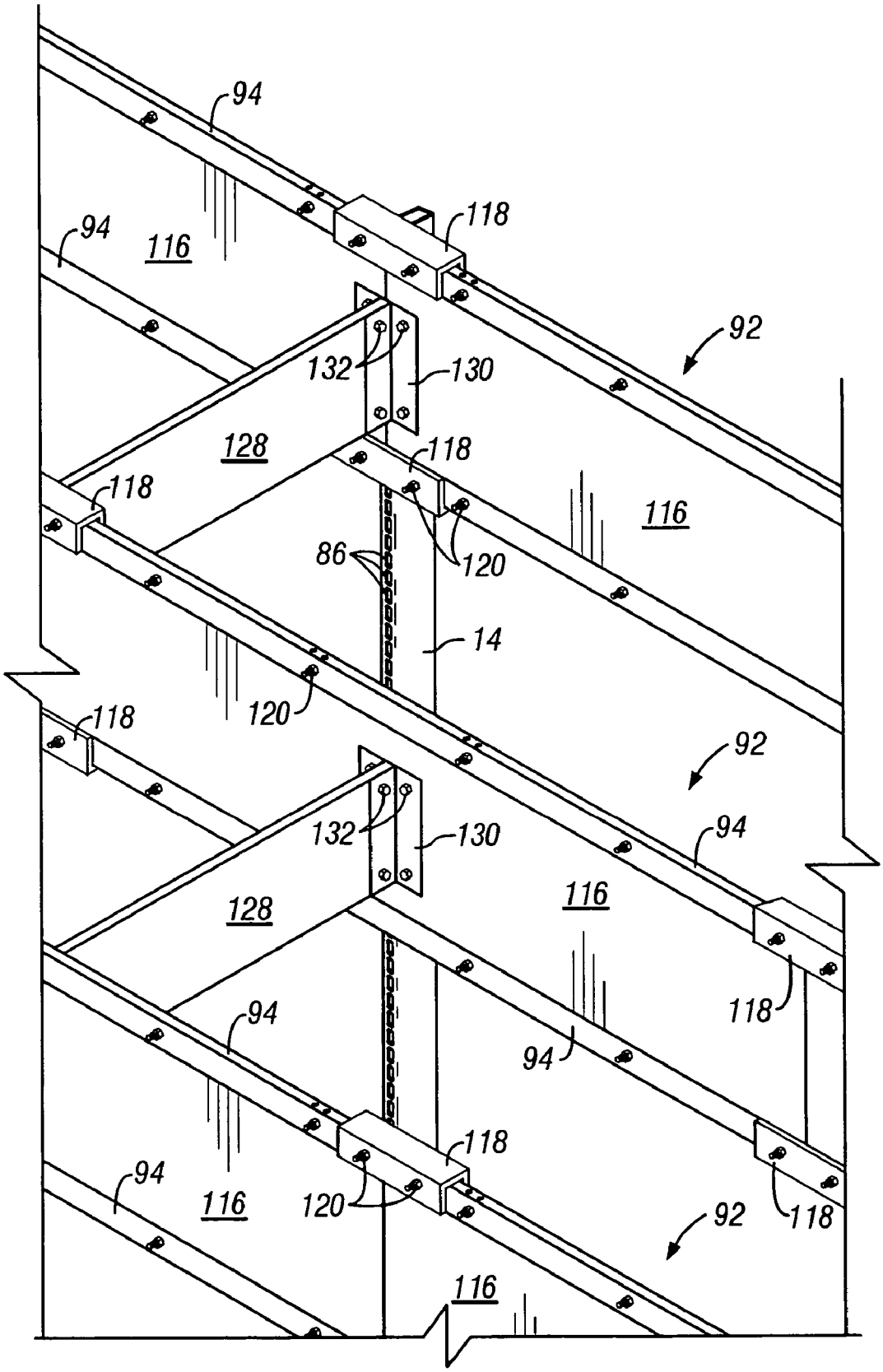
FIG. 31 is a top perspective view of truss assembly structures of the modular room illustrated in FIG. 1.

If desired, multiple panels 116 can be used in a truss member 92 as shown in the figures. In such cases, the panels 116 are preferably spliced together by splicer beams 118 that can take the form of C-shaped channels spanning the spliced area of the panels 116 as best shown in FIGS. 28 and 31. Splicer beams 118 are not necessarily required for a strong splice between panels 116, such as when the truss beams 94 run uninterrupted past the spliced area. However, splicer beams 118 are preferably employed for additional truss strength and rigidity. The truss splicer beams 118 can be attached to the truss 92 in a number of different ways, such as by welding the truss splicer beams 118 to the truss beams 94 or by attaching the truss splicer beams 118 to the spliced area with conventional fasteners, etc. Most preferably, bolts 120 are received within apertures in the truss splicer beams 118, truss beams 94, and spliced panels 116 as shown in FIGS. 28 and 31.

Although C-shaped truss beams 94 and splicer beams 118 are preferred, these elements can take a number of other forms capable of providing strength and rigidity to the truss 92. For example, the truss beams 94 and/or the splicer beams 118 can have an L-shaped cross section for overlapping the edge and an adjacent side of panels 116, can be substantially flat and run along the edge of the panels 116, and the like.

The trusses 92 can be attached to the primary uprights 14 in a number of different ways. For example, the trusses 92 can be connected to the primary uprights 14 by lateral connectors such as those described above, by brackets having fingers that are received within the apertures 86 of the primary uprights 14 in a manner similar to the base leg bracket assembly 36 described above, by conventional threaded fasteners, and the like. In some highly preferred embodiments however, truss devises 122 are attached to the ends of the trusses 92 with bolts 125 as best shown in FIG. 29. Like the truss splicer beams 118, the truss devises 122 are preferably channels attached to the edges of the trusses 92 by bolts 125 passed through apertures in the truss devises 122, truss beams 94, and panels 116. Alternatively, the truss devises 122 can be attached to the trusses 92 by welding or in any other conventional manner, and can take any of the other forms described above with reference to the truss beams 94 and truss splicer beams 118. Preferably, the truss devises 122 are attached to the primary uprights 14 by pins, posts, or conventional threaded fasteners 124 passing through aligned apertures in the uprights and truss devises 122.

In the case where additional force is exerted upon the primary uprights 14, such as by a soffit 24 as shown in the embodiment of the present invention illustrated in FIG. 1, the primary uprights 14 can be supported by a truss clevis 122 adapted for this purpose. With reference to FIG. 30 for example, the top truss clevis 122 illustrated in FIG. 29 can be replaced with the truss devises illustrated in FIG. 30 adapted to support additional force exerted by the soffit or other additional structure. The truss clevis 122 illustrated in FIG. 30 preferably includes a gusset plate 126 adapted to connect to the primary upright 14 at two locations (rather than at only one location as illustrated in FIG. 29), thereby transferring weight from the soffit 24 or other additional structure to the truss 92. If necessary, an extension can be attached to the primary upright 14 to provide a connection location for the top truss clevis 122. As used herein, the term "primary upright 14" includes a unitary member as well as a member constructed of two or more elements (including extensions). One having ordinary skill in the art will appreciate that other elements having different shapes and manners of connection can instead be used to accomplish the function of the truss devises 122 and gusset plate 126 illustrated in the figures, each one of which falls within the spirit and scope of the present invention. For example, the plate 126 can be replaced by a frame having one or more rods or cables (e.g. a rod running from the top clevis 122 diagonally toward the truss beam 94), by one or more beams extending from the top truss clevis 122 toward the truss beam 94, and the like. If desired, a rail 119, beam, or other element preferably similar to the splicer beam 118 or truss beam 94 can connect either or both truss devises to the truss 92.

For additional overhead structure strength and rigidity, some preferred embodiments employ bridge members 128 between the trusses 92 to withstand lateral forces exerted on the trusses 92. The bridge members 128 (see, for example, FIG. 31) are preferably panels that can be connected to adjacent trusses 92 in any conventional manner, such as by the angle brackets 130 and threaded fasteners 132 shown in the figures. In other embodiments, the bridge members 128 can take the form of rods, beams, bars, or tubes connected to and between adjacent trusses 92 in any conventional manner and performing the same functions of the panel-type bridge members 128 described above.

Figure 38:
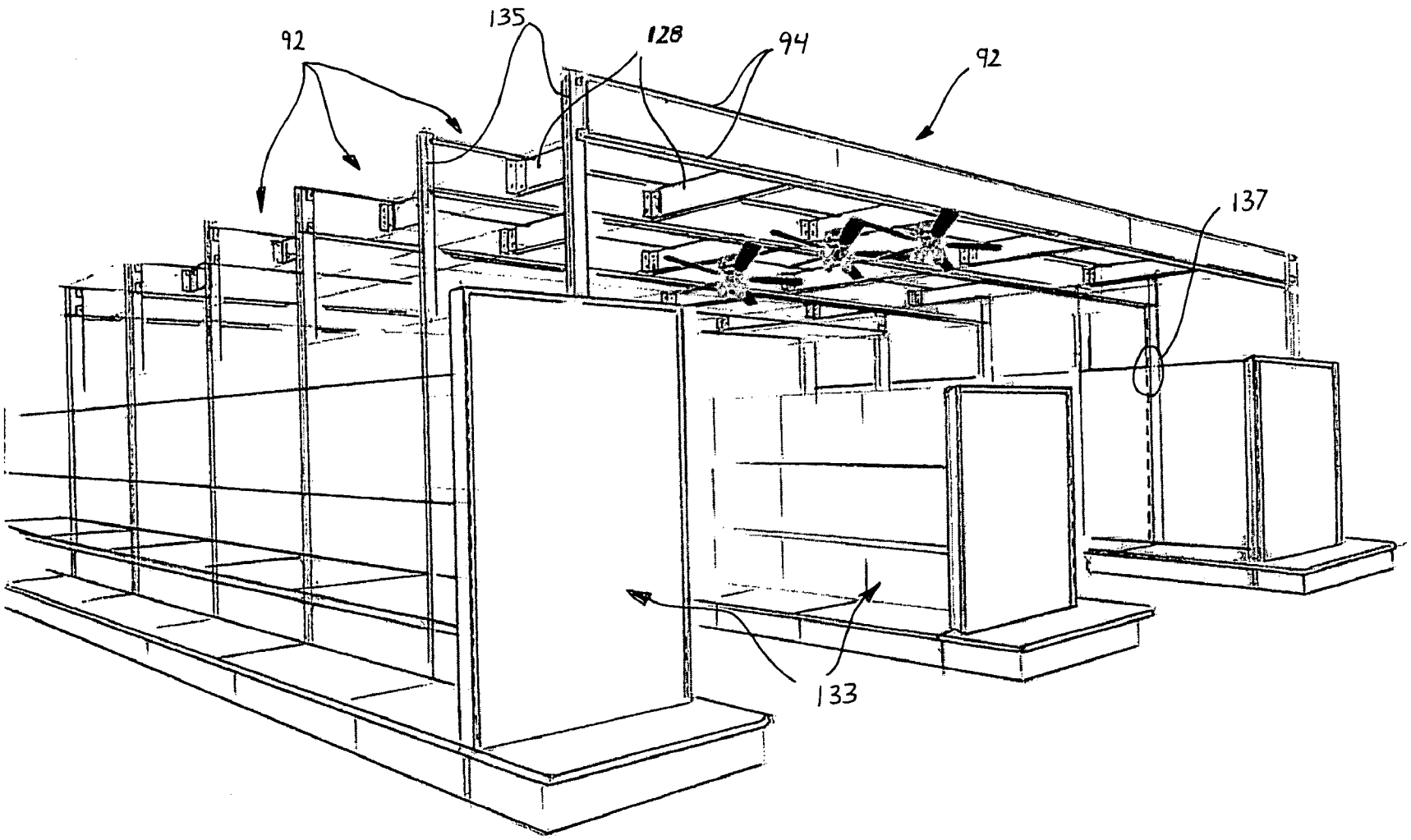
FIG. 38 is a perspective view of an application of the truss assembly structures according to an embodiment of the present invention.

FIG. 38 is a perspective view of multiple overhead trusses 92 according to an embodiment of the present invention in which the trusses 92 are connected to and extend over modular product storage and display units 133. Any number of trusses 92 can be connected to and extend over the product storage and display units 133 (e.g., a single truss 92 spanning over an isle between two rows of shelves, a number of such trusses 92 in parallel and spaced along a length of the shelves, and the like). In some embodiments, at least some of the trusses 92 are connected by bridge members 128 in a manner as described above, although such bridge members 128 need not necessarily be employed in other embodiments.

In the exemplary embodiment illustrated in FIG. 38, multiple trusses 92 are connected to and extend over gondola-based shelving units 133, and are configured with the shelving units 133 to provide desirable features, aspects, and/or benefits over conventional supporting structure and/or methods. However, any number of the trusses 92 can be connected to and extend over any other type of product storage and display unit or combination of such units, including without limitation bins, shelving, warehouse or retail racks, stands, cabinets, cases, coolers and other enclosures, and the like. By way of example only, in some embodiments of the present invention, the trusses 92 bridge two or more gondola-based shelving units 133 to generally provide a canopy between the shelving units 133. As another example, the trusses 92 can be connected to a set of warehouse-type racks on one end and a set of coolers on another end, and can span across any number of shelving units between the racks and coolers. Any other combination of product storage and display units 133 can be employed for mounting the overhead trusses 92.

In those embodiments in which trusses 92 according to the present invention are connected to product storage and display units 133, the trusses 92 can be mounted to any portion of the product storage and display units 133, including without limitation on panels of the product storage and display units 133, on uprights, stretchers, and other frame elements of the product storage and display units 133, and the like. The trusses 92 can be mounted to such portions of the product storage and display units 133 in any suitable manner, such as by bolts, screws, rivets, pins, or other fasteners passed through apertures on the ends of the trusses 92, clamps securing flanges of the truss beams 94 or other portions of the trusses 92, inter-engaging elements (e.g., fingers or headed posts on the trusses 92 engaging in apertures or other elements on the product storage and display units 133, and vice versa), and the like. By way of example, the trusses 92 can be secured to uprights of (or attached to) the product storage and display units 133 in any of the manners described above, as well as with reference to the embodiments illustrated in FIGS. 29 and 30.

In some embodiments, one or more overhead trusses 92 according to the present invention can be mounted to structure other than modular product storage and display units in order to span any part of such units. For example, one or more of the overhead trusses 92 can be mounted to interior or exterior walls of a building structure, to partitions, beams, or frames in the building structure, and the like. As another example, one end of each truss 92 in a set of trusses 92 can be connected to gondola-based shelving units 133 in a manner similar to that shown in FIG. 38, while another end of each truss 92 can be mounted to an exterior wall or stanchions of a building structure. In these embodiments, the trusses 92 can be mounted to such structure in any suitable manner, including in any of the manners described above with reference to the other truss embodiments and other manners of mounting trusses according to the present invention.

The overhead truss(es) 92 can span over any number and type of product storage and display units 133 desired, as well as over any other structure and elements and environment. For example, overhead trusses 92 can span a single isle, can span over multiple isles separated in any manner (such as by one or more product storage and display units 133 which may or may not be connected to the overhead trusses 92), and can span over any other structure or elements (e.g., islands, counters, merchandise and other product, equipment, open spaces, and the like).

A number of elements and structures can be suspended from one or more trusses 92 according to the present invention. By way of example only, any number of signs, displays, lighting fixtures, fans, electrical, gas, ventilation, or plumbing elements, products and merchandise, and other elements can be suspended from and/or supported by the trusses 92.

As shown in FIG. 38, in some embodiments, multiple trusses 92 can define a canopy. Such trusses can be a network of trusses 92 above traffic passing between product storage and display units 133. A canopy can be desirable for suspending and/or supporting products and for displaying signage (e.g., in relatively close proximity to potential customers and other traffic passing between the shelving units 133), or for suspending and/or supporting any of the other elements or structure described above. If not for the overhead trusses 92, products, signage, and other elements would have to be supported and/or suspended in other manners, such as from rafters or other structure in the building enclosing the shelving units 133. In warehouse-style retail stores which often employ relatively high ceilings, supporting and/or suspending products and/or signage from rafters can be undesirable.

In another aspect of the invention, the network of trusses 92 and bridge members 128 can also support a suspended ceiling (not shown). Such a suspended ceiling can be desirable to shelter traffic passing between the shelving units 133 from environment outside of the structure which the trusses 92 spans. In addition, the suspended ceiling can support lighting modules for the shelving units 133, signage and other displays, HVAC equipment, and other devices and equipment as desired.

The trusses 92 in the illustrated embodiment of FIG. 38 are substantially the same as those previously described and illustrated in FIGS. 28–31. In addition, the truss beams 94 connecting the trusses 92 to uprights, upright members 135, or other structure as described above, and the bridge members 128 connecting adjacent trusses 92 are substantially the same as those previously described and illustrated in FIGS. 28–31. As shown in the exemplary embodiment of FIG. 38, the upright members 135 supporting the overhead trusses 92 are integral components of the shelving units 133. The upright members 135 can be configured in substantially the same manner as the uprights 14 illustrated in FIG. 29, such that shelves can be releasably coupled to the upright members 135 via apertures 137 in the upright members 135.

Another valuable aspect of the present invention is the ability to use various components of the modular room 10 as both external and internal room components. Specifically, those elements of the present invention that define the outer walls or perimeter of the modular room (e.g., upright members, wall panels, stretchers, doors, window assemblies, pass-thrus, and the like) are designed to fit within the framework defined by the primary uprights 14, which are assembled at predetermined distances such as by 24", 32", or 48" on center. Because the primary uprights 14 are preferably (although not necessarily) separated by such standard distances, these elements can be manufactured and supplied in such sizes and can be readily assembled and/or installed without on-site modification. This modularity is a valuable aspect of the present invention, because it permits a user to design a room layout based at least partially upon known spacings between the primary uprights 14. Furthermore, fixtures and other elements connected to the primary uprights 14 can also be manufactured and supplied in predetermined sizes for use with such standardized construction, thereby further increasing the modularity of the room 10. For example, with the standard spacing between the primary uprights 14 known, a user can easily select and arrange the layout of the fixtures inside and outside of the room 10. Because fixtures are preferably manufactured in standard sizes, they can also be quickly supplied and assembled and installed without on-site modification.

Figure 35:
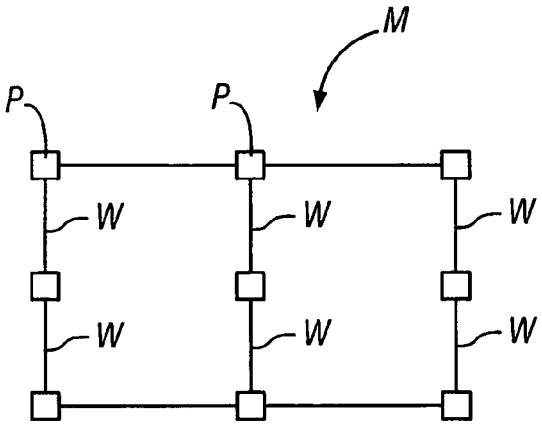
FIG. 35 (Prior Art)
FIG. 35 is a top schematic view of a primary upright and wall arrangement according to a prior art modular room.
Figure 36:
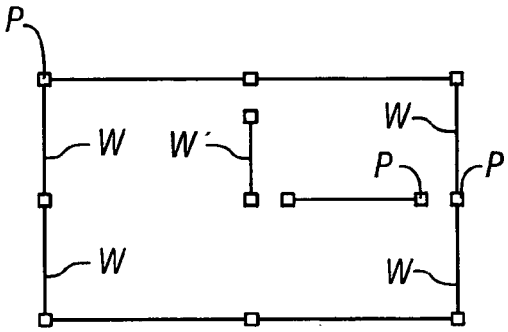
FIG. 36 (Prior Art)
FIG. 36 is a top schematic view of a primary upright and wall arrangement according to another prior art modular room.

However, when a designer wishes to employ a standard-sized modular room component or fixture for the inside of the modular room 10, an issue may arise regarding the location of interior primary uprights 14. For example, without compensation, a standard-sized wall panel for an exterior wall of the modular room 10 would normally be too large to use as an interior wall in the room because the wall is located within an enclosed area defined by identically-sized walls. This can present problems when the room designer wishes to align the primary uprights 14 of the exterior walls with the primary uprights 14 of the interior walls. This problem is illustrated in FIGS. 35 and 36, and is discussed in greater detail in the background above.

In order to address the problems just described, some embodiments of the present invention employ anchor assemblies 26 designed to align interior and exterior walls extending from a common wall of the modular room so that the edges of the interior and exterior walls are aligned the same (or substantially the same) distance from the common wall. Each of these anchor assemblies 26 is designed to mount multiple primary uprights 14: at least one primary upright 14 to which one or more exterior wall panels 12, stretchers 28, or other wall components can be connected and at least one primary upright 14 to which one or more interior wall panels 12, stretchers 28, or other wall components can be connected. This enables the use of primary uprights 14 that are adapted for mounting to wall panels 12, stretchers 28, or other wall components on less than all sides of the primary uprights 14 and primary uprights 14 that are smaller in shape and have a more efficient load bearing design (e.g., primary uprights 14 having an elongated rectangular cross-sectional shape rather than a square cross-sectional shape). Four such anchor assemblies 26 are illustrated in FIGS. 15–17, 18–20, 22, and 23.

Figure 14:
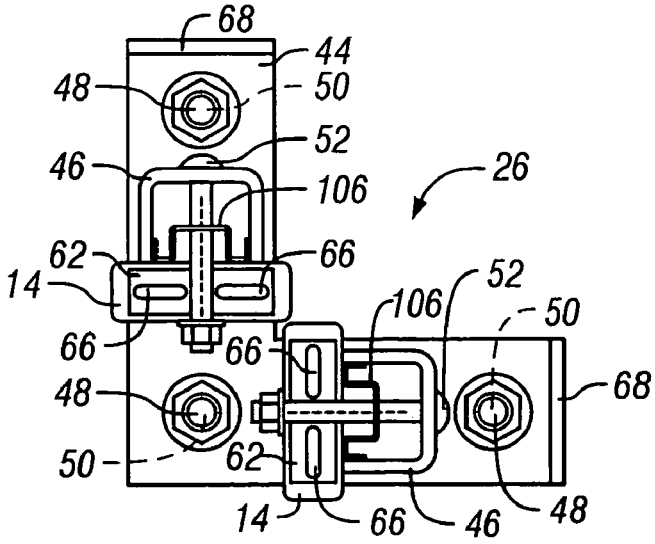
FIG. 14 is a top view of the second anchor assembly and two primary uprights illustrated in FIG. 13.
Figure 15:
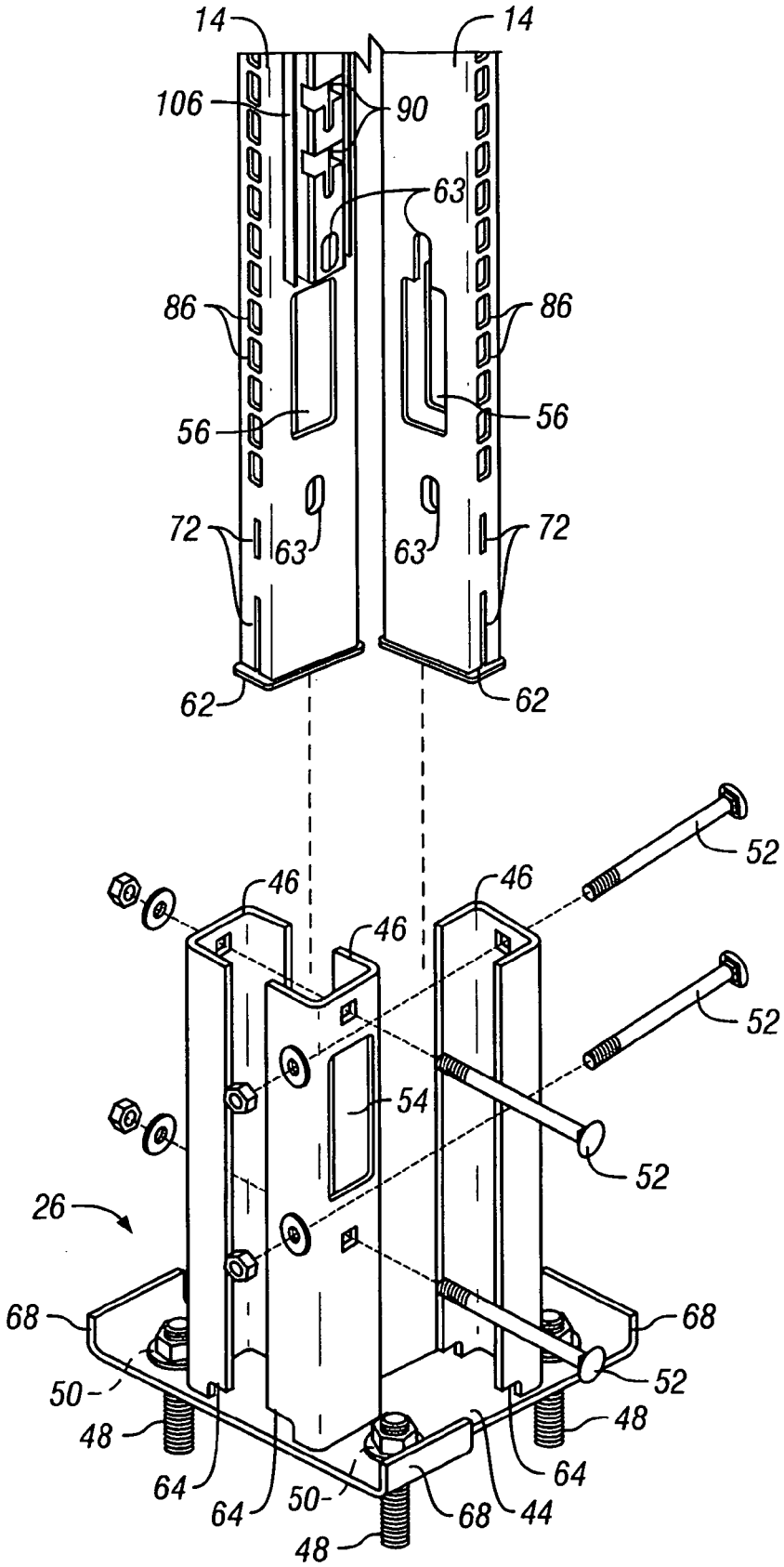
FIG. 15 is an exploded perspective view of a third anchor assembly and two primary uprights of the modular room illustrated in FIG. 1.
Figure 16:
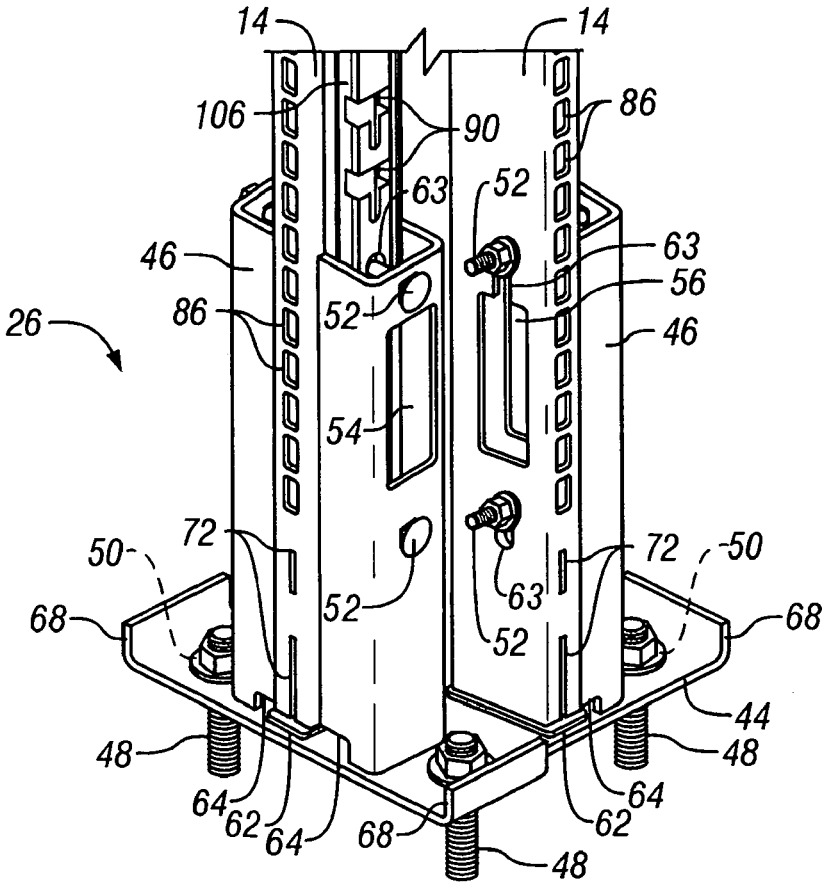
FIG. 16 is an assembled perspective view of the third anchor assembly and two primary uprights illustrated in FIG. 15.
Figure 17:
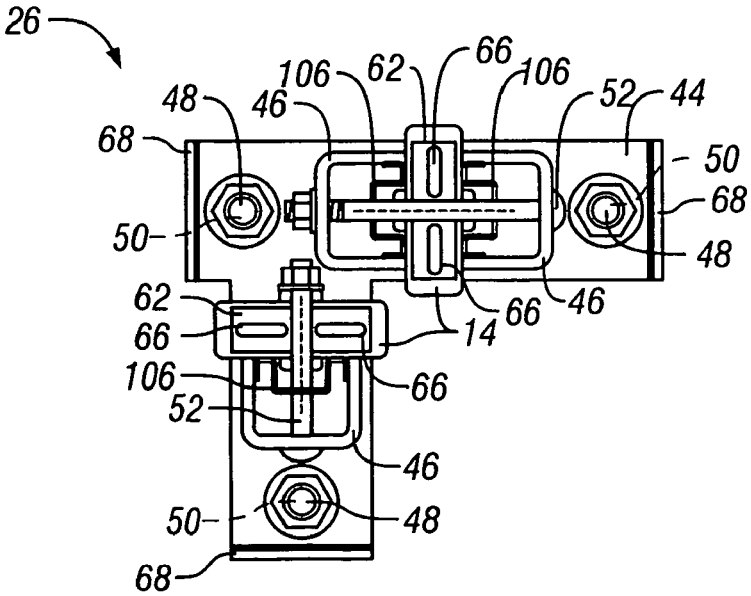
FIG. 17 is a top view of the third anchor assembly and two primary uprights illustrated in FIG. 16.
Figure 18:
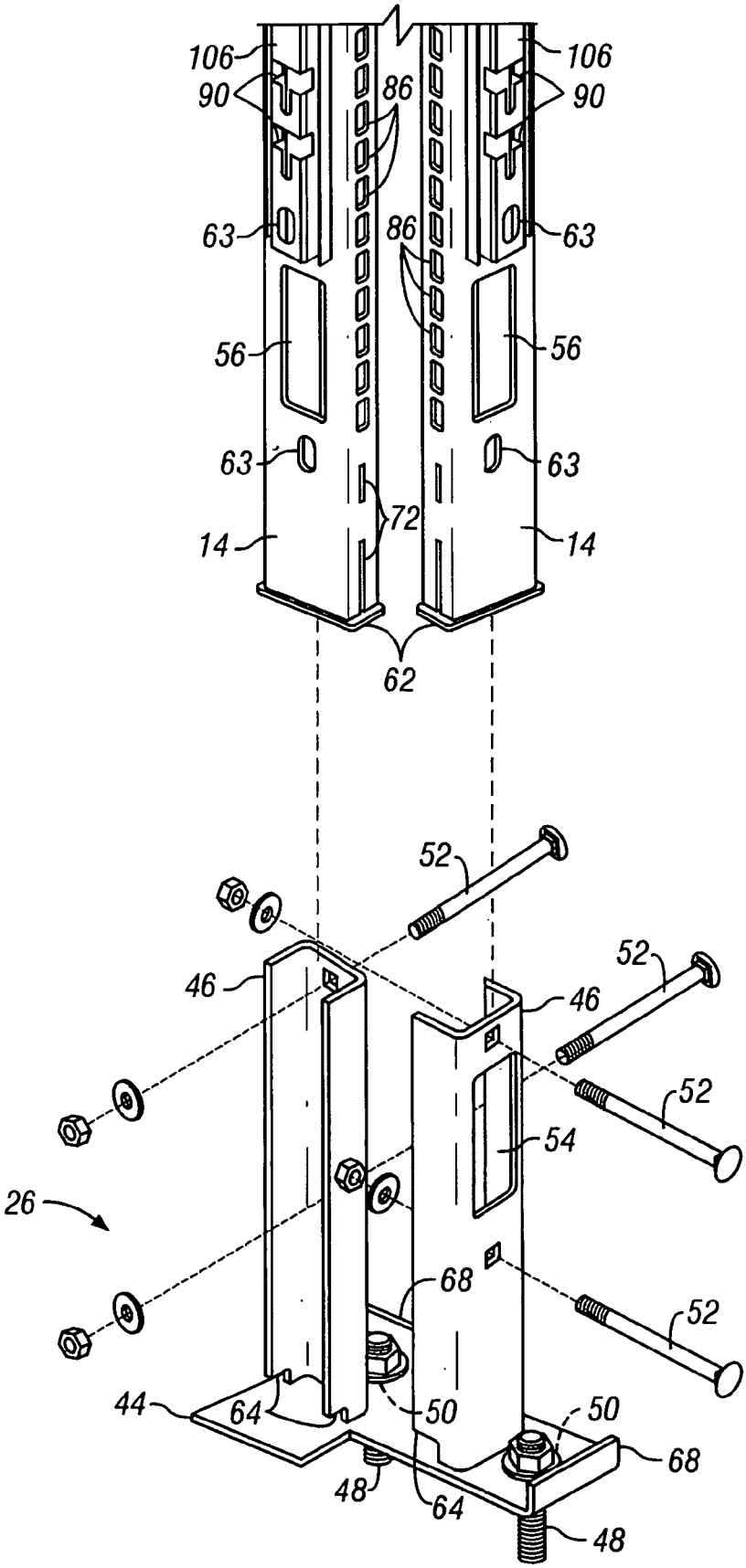
FIG. 18 is an exploded perspective view of a fourth anchor assembly and two primary uprights of the modular room illustrated in FIG. 1.
Figure 19:
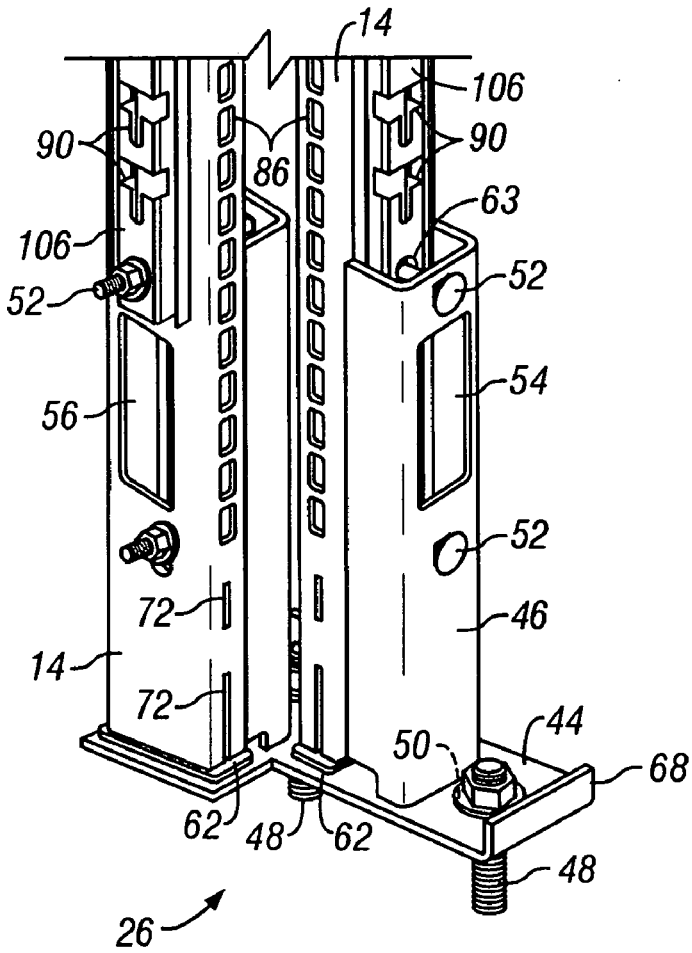
FIG. 19 is an assembled perspective view of the fourth anchor assembly and two primary uprights illustrated in FIG. 18.
Figure 20:
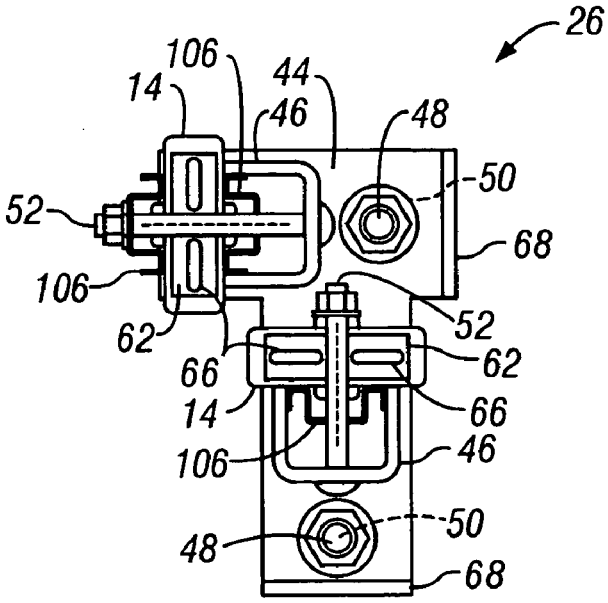
FIG. 20 is a top view of the fourth anchor assembly and two primary uprights illustrated in FIG. 19.
Figure 21:
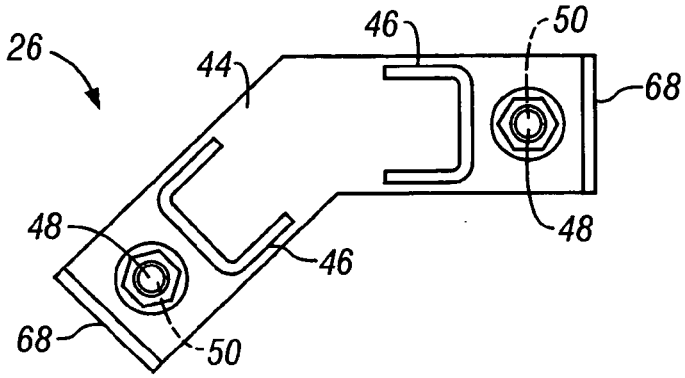
FIG. 21 is a top view of a fifth anchor assembly according to the present invention.
Figure 22:
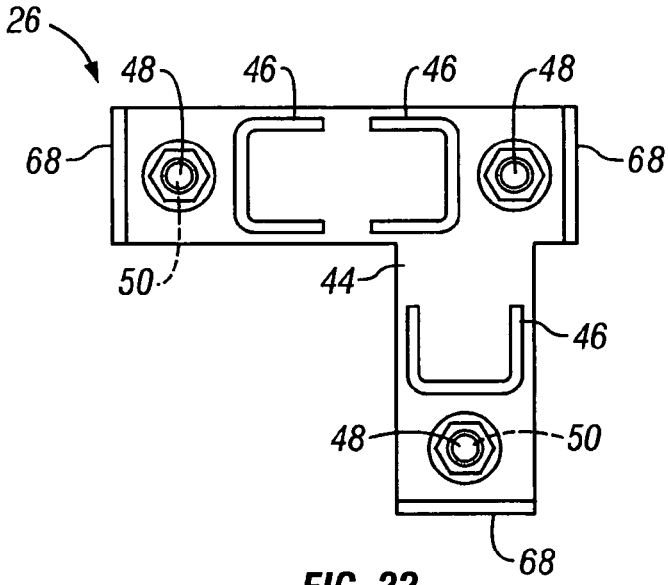
FIG. 22 is a top view of a sixth anchor assembly according to the present invention.
Figure 23:
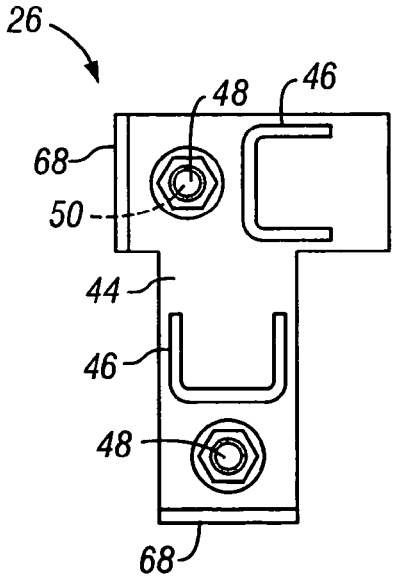
FIG. 23 is a top view of a seventh anchor assembly according to the present invention, used to connect portions of a wall together at an angle other than a 90° angle.
Figure 37:
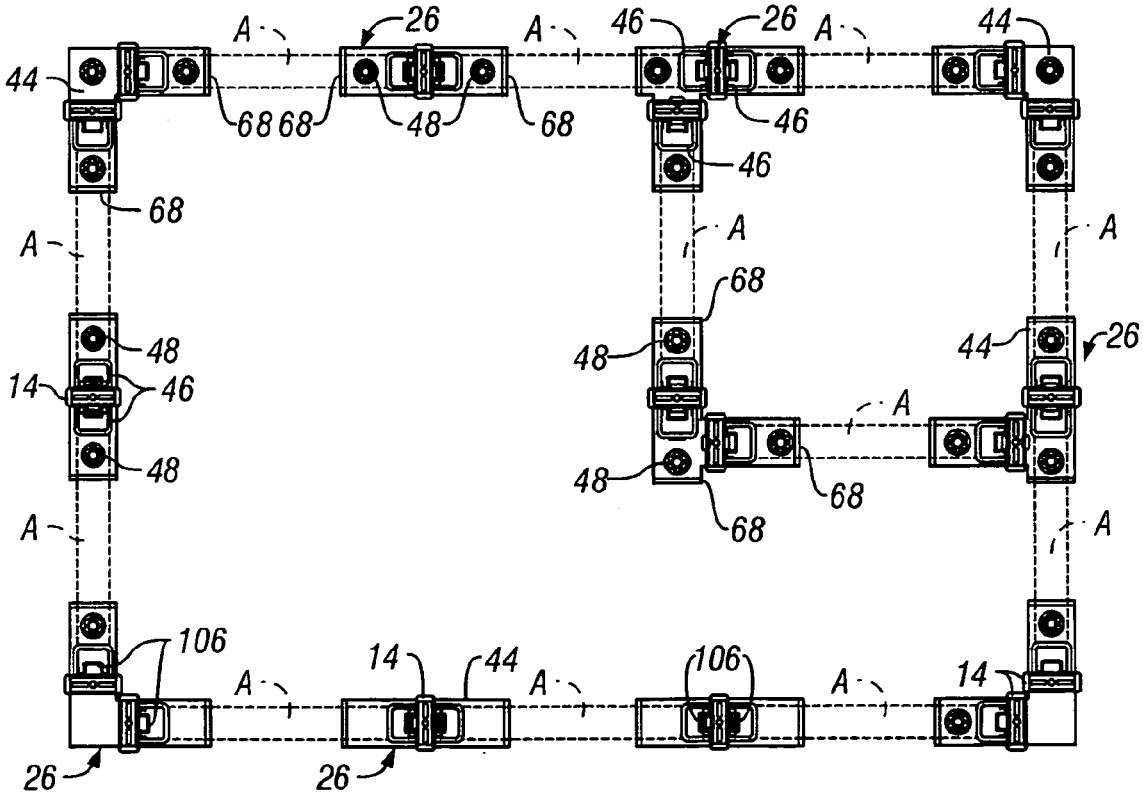
FIG. 37 is a top schematic view of a primary upright and wall arrangement according to a preferred embodiment of the present invention.

In some preferred embodiments of the present invention where standard-sized internal walls, components, and fixtures (as described above) are desired for the modular room 10, the anchor assemblies 26 illustrated in FIGS. 15–17, 18–20, 22, and 23 can be used to join an exterior room wall with an interior room wall. With particular reference to FIG. 37 for example, a plurality of anchor assemblies 26 and primary uprights 14 are illustrated and are used to illustrate joining of an exterior room wall with an interior room wall. With reference to FIGS. 15–17 for example, this type of anchor assembly 26 is preferably connected to a primary upright 14 of the exterior wall and a primary upright 14 of the interior wall. Due to the location of the upright members 46 on the base plate 44, the interior wall primary upright 14 (the bottom primary upright 14 in FIG. 17) connected thereto is offset a distance from the center of the exterior wall primary upright 14 (the top primary upright in FIG. 17) within the exterior wall. With reference to the anchor assembly 26 illustrated in FIG. 14, this offset distance is preferably the same distance between the center of one exterior primary upright 14 from the other exterior primary upright in the corner anchor assembly 26 illustrated in FIG. 14. In other words, with respect to an exterior wall of the modular room 10, a primary upright 14 in each of the anchor assemblies 26 illustrated in FIGS. 14 and 15 is preferably located the same distance from the center of the exterior wall to which the anchor assemblies 26 are connected.

As a result, all of the primary uprights 14 in the exterior wall are preferably located the same distance from primary uprights adjacent to the exterior wall on the same anchor assemblies 26 (such as primary uprights 14 of abutting interior walls or primary uprights 14 of adjacent exterior walls). Therefore, the same wall panels 12, stretchers 28, and other wall components (i.e., having the same dimensions) available for use with the exterior of the modular room 10 can preferably be used for the room interior. This significantly reduces the number and types of parts needed for manufacturing and assembling a modular room with interior walls, components, and fixtures, increases assembly speed, and lowers the cost of the modular room 10.

With reference again to FIGS. 4–6, some preferred embodiments of the present invention have mop boards 30 that are attached to the bottom walls of the modular room 10 in order to at least partially enclose or hide the anchor assemblies 26, primary uprights 14, and other elements located at or near floor level. Because the primary uprights 14 are preferably vertically adjustable as described above to level the walls of the modular room 10, it is desirable to use mop boards 30 that can be adjusted to be flush with the floor in order to accommodate different positions of the primary uprights 14 and the wall components connected thereto. Therefore, the present invention preferably employs vertically adjustable mop boards 30. The mop boards 30 are preferably connected to the primary uprights 14 and/or the anchor assemblies 26 by threaded fasteners 134 passed through apertures 32 in the mop boards 30 and into elongated apertures 136 in the primary uprights 14 and/or anchor assemblies 26 (see FIGS. 5 and 6). In the illustrated embodiments of the present invention, the elongated apertures 136 are in the primary uprights 14, but could instead be in the anchor assemblies 26. By loosening the threaded fasteners 134, the mop boards 30 can preferably be lowered or raised to a desired position and can be secured in place by again tightening the threaded fasteners 134. One having ordinary skill in the art will appreciate that elongated vertical apertures in the mop boards 30 (through which the threaded fasteners are passed) can be used to accomplish the same function. Other ways of releasably connecting the mop boards 30 to the bottoms of the room walls are possible. For example, the mop boards 30 can be releasably connected in varying locations by one or more clips, pegs, pins, and the like received within different apertures at different heights or within elongated apertures or slots in the mop boards 30 and/or the anchor plates 26 or primary uprights 14. These and other alternative adjustable connection methods fall within the spirit and scope of the present invention.

Figure 33:
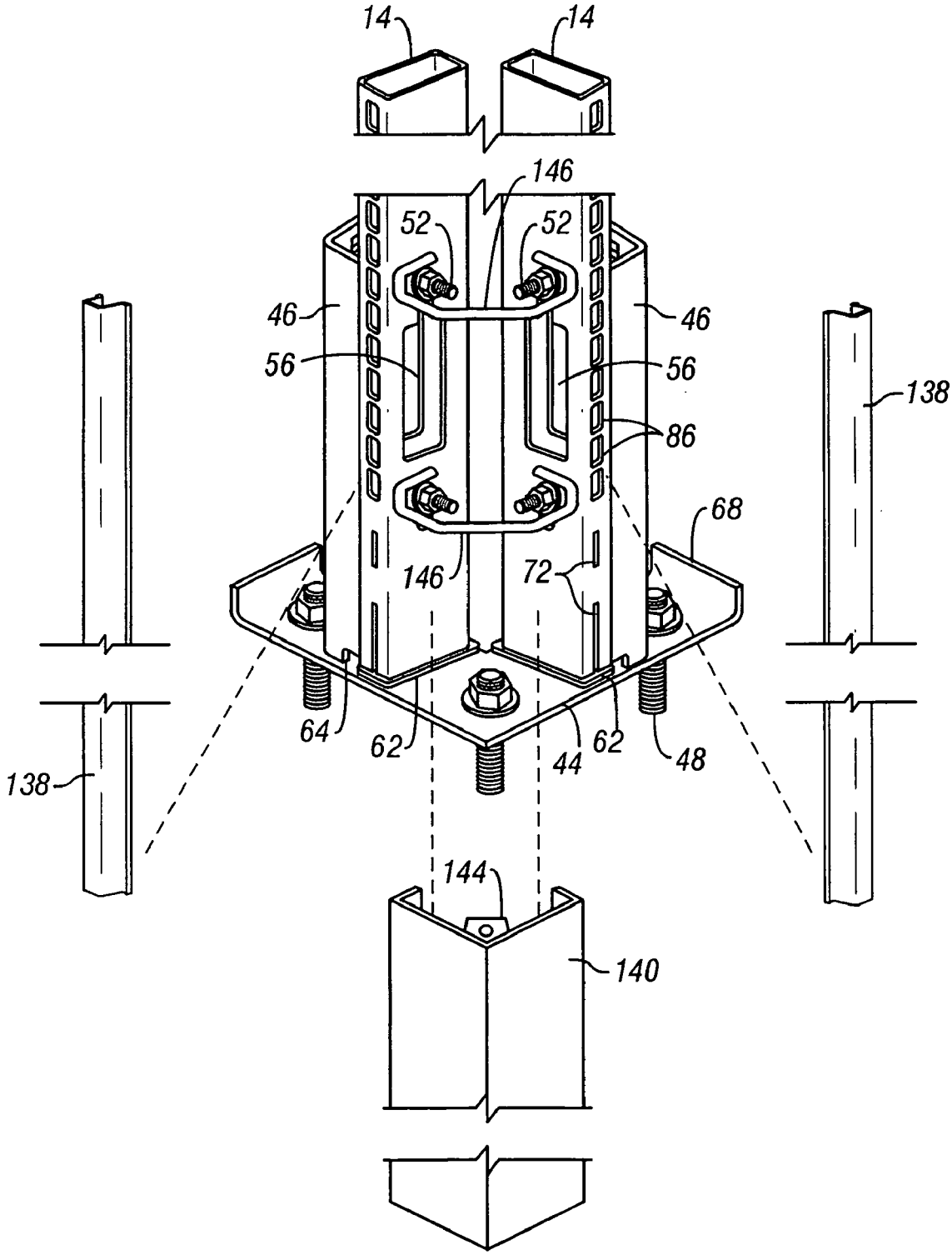
FIG. 33 is a perspective exploded view of an anchor and primary upright assembly with modesty strips.
Figure 34:
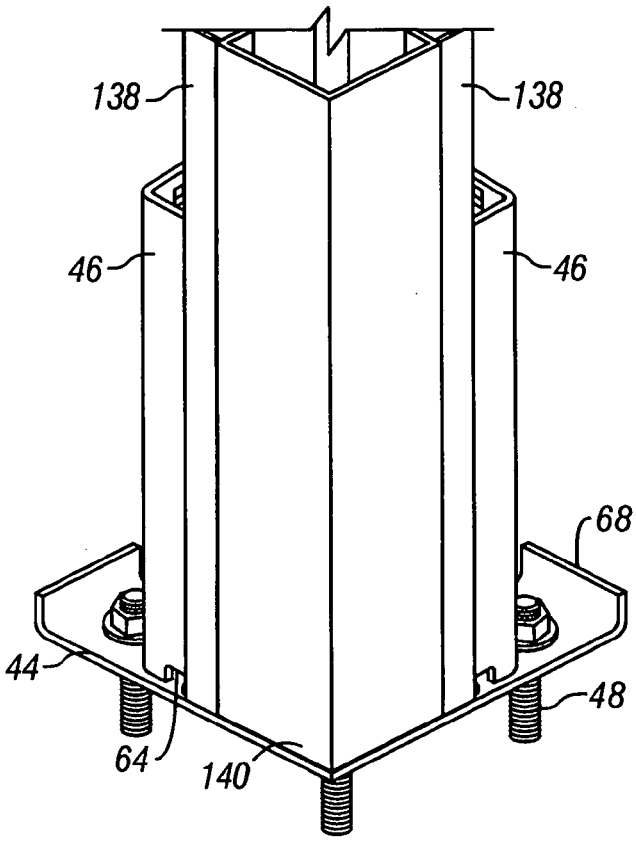
FIG. 34 is a perspective assembly view of the anchor and primary upright assembly with modesty strips illustrated in FIG. 33.

With reference to FIGS. 33 and 34, some preferred embodiments of the present invention employ modesty strips 138, 140 in order to cover or otherwise at least partially hide the primary uprights 12 of the modular room 10, thereby also preferably hiding apertures and other connecting structure of the primary uprights 14. Two examples of such modesty strips are illustrated in FIGS. 33 and 34: upright modesty panels or strips 138 and corner modesty panels or strips 140. In the illustrated embodiments, the upright modesty strips 138 are preferably used to cover apertures 86 that are not being used to hang fixtures or other components therefrom, while corner modesty strips 140 are used to improve the appearance of room corners, such as by rounding or squaring off the corners or by covering a gap created by adjacent panels at a corner of the modular room 10.

Figure 34A:
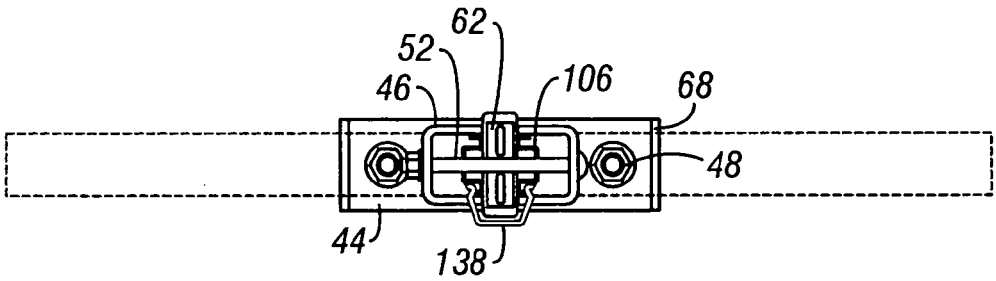
FIG. 34A is a top view of the first anchor assembly and primary upright illustrated in FIG. 11 with a modesty strip.
Figure 34B:
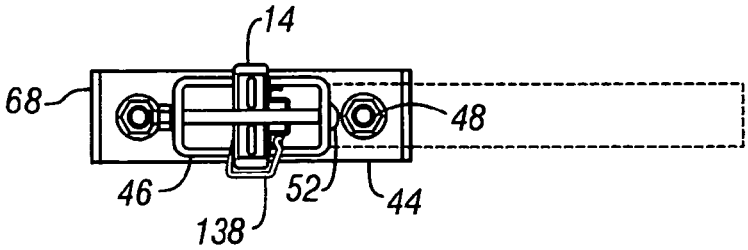
FIG. 34B is a top view of an anchor assembly and primary upright with an alternative modesty strip.

In some embodiments, the upright modesty strips 138 have fasteners for fastening the upright modesty strips 138 to the primary uprights 14. In other embodiments, the upright modesty strips 138 have resilient clips that insert into apertures 86 of the primary uprights 14 and thereby engage the primary uprights 14 to secure the upright modesty strips 138 in place. Any number of resilient clips can be used to connect the upright modesty strips 138 to the primary uprights 14. Preferably, the fasteners are integral with the modesty strips such as the resilient clips. Although resilient clips are preferred, other types of fasteners and fastening methods can be employed to secure the modesty strips 138 in place on the uprights 14, including without limitation screws, nails, brads, staples, pins, posts, fingers, magnets, and any other conventional fastener. In the illustrated embodiments of FIGS. 33, 34, 34A and 34B, the upright modesty strip 138 can be C-shaped with resilient ends that engage side surfaces of the primary upright 14 and thereby resiliently connect the upright modesty strip 138 to the primary upright 14. Preferably, the upright modesty strip 138 engages the edges of the rail 106 as best illustrated in FIGS. 34A and 34B. In instances where a rail 106 is not connected to both sides of the primary upright 14, the upright modesty strip engages the side of the primary upright 14. The side of the modesty strip 138 that engages the non-rail 106 side of the upright 14 may not include a projection as best illustrated in FIG. 34B. The projection may be trimmed from the modesty strip or the modesty strip 138 may be manufactured without the projection. In other embodiments, the upright modesty strips 138 can be welded to or integrally formed with the primary uprights 14.

In some embodiments, the upright modesty strip 138 can be attached to cover a face of a primary upright 14 and can have one or more legs extending to an adjacent side of the primary upright 14. Two examples of such modesty strips 138 are illustrated in FIGS. 34A and 34B. In the embodiment shown in FIG. 34A, the modesty strip 138 has an Omega-shaped cross section, and has resilient legs straddling the primary upright 14 to retain the modesty strip 138 upon the primary upright 14. If desired, and depending at least in part upon the manner in which wall panels 12 and other structure are connected to the primary upright 14, either or both legs of the modesty strip 138 can be received between a wall panel 12 connected to the primary upright 14 and a sidewall of the primary upright 14. This can provide a more secure connection of the modesty strip 138 to the primary upright 14. In some highly preferred embodiments, either or both legs of the modesty strip 138 are engagable with a recess, wall, or other feature or element on the primary upright 14. With reference to FIG. 34A for example, the legs of the modesty strip 138 are received within a groove of the rail 106, thereby providing a more positive engagement of the modesty strip 138 with the primary upright 14. In addition, this engagement (along with the other types of resilient engagement of the modesty strips described above) can also be sufficiently strong to obviate the need for fasteners to mount the modesty strip 138.

In some cases, it may be desirable for the modesty strip 138 to extend around the primary upright 14 on only one side thereof (such as when the primary upright 14 is laterally attached to a wall panel 12 or other wall components on only one side of the primary upright 14). In such a case, the modesty strip 138 can be adapted to only extend to one side of the primary upright 14. An example of such a modesty strip is illustrated in FIG. 34B.

The corner modesty strips 140 of the illustrated preferred embodiment in FIGS. 33 and 34 can be connected to one or more adjacent primary uprights 14 in any of the manners described above with reference to the upright modesty strips 138. Alternatively or in addition, the corner modesty strips 140 can include a hook and screw assembly 144. Specifically, the corner modesty strips 140 can be connected to adjacent primary uprights 14 by hooking the hook and screw assembly 144 over a wire 146 attached to the primary uprights 14 and by tightening the hook and screw assembly 144 to the wire 146. In other embodiments, the corner modesty strips 140 can be connected to the primary uprights in still other manners falling within the spirit and scope of the present invention. For example, fasteners or external clips can be used to connect the corner modesty strips 140 to the primary uprights 14. As another example, the corner modesty strips 140 can be resiliently held between the primary uprights 14 by resilient flanges of the corner modesty strips. In still other embodiments, the corner modesty strips 140 can be welded to or integrally formed with either or both adjacent primary uprights 14.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

I claim:

1. A modular room upright assembly for use in a modular room constructed upon a floor surface, the modular room upright assembly comprising:

a substantially vertical elongated upright having a wall at least partially defining an interior of the upright;

a bottom end adjacent to the floor surface; and a first aperture in the wall;

a bracket coupled to the bottom end of the upright, the bracket having:

a first portion received within the first aperture of the upright, extending longitudinally within the interior of the upright to the bottom end of the upright, and having a distal end releasably coupled to a second aperture defined in an interior wall of the upright;

a second portion extending away from the upright to a location disposed from the upright; and a foot coupled to the second portion and positioned to rest upon the floor a distance from the upright.

2. The modular room upright assembly as claimed in claim 1, wherein the interior wall of the upright is at least partially defined by an end wall of the upright closing the bottom end of the upright.

3. The modular room upright assembly as claimed in claim 2, wherein the end wall at least partially defines the second through which an end of the first portion of the bracket extends to engage the end wall of the upright.

4. The modular room upright assembly as claimed in claim 1, wherein the first portion extends through the bottom end of the upright.

5. The modular room upright assembly as claimed in claim 1, wherein the first portion of the bracket is received within an aperture in the interior wall of the upright.

6. A modular room upright assembly adapted to be coupled to the floor, comprising:

an elongated and substantially vertical upright having a bottom end;

a base plate adapted to be connected to the floor by at least one fastener;

a member extending from the base plate adjacent to the substantially vertical upright;

a foot coupled to the bottom end of the vertical upright via a threaded connection and resting upon the base plate; the threaded connection adjustable while the foot is upon the base plate to raise and lower the upright with respect to the foot in order to raise and lower the upright to different positions with respect to the base plate and floor; and a fastener received in a first aperture through the upright and a second aperture through the member, at least one of the first and second apertures being shaped to receive the fastener in a plurality of positions of the upright with respect to the member to retain the upright in place against the member in at least two of the plurality of positions.

7. The modular room upright assembly as claimed in claim 6, wherein the foot is a head of a threaded fastener received within a threaded aperture defined in the bottom end of the upright.

8. The modular room upright assembly as claimed in claim 6, wherein one of the first and second apertures comprises an elongated aperture, and wherein the fastener is adapted to releasably secure the upright against the member in different relative positions.

9. The modular room upright assembly as claimed in claim 6, wherein the upright is adapted to be clamped to the member.

10. The modular room upright assembly as claimed in claim 6, wherein the member has an aperture defined therein located to permit access to the foot with a tool.

11. The modular room upright assembly as claimed in claim 6, wherein the foot can be turned to raise and lower the upright to different vertical positions with respect to the member.

12. A modular room upright assembly for use in a modular room constructed upon a floor surface, the modular room upright assembly comprising:

a substantially vertical elongated upright having a first wall at least partially defining an interior of the upright;

a bottom end adjacent to the floor surface;

a second wall extending transversely across the interior of the upright; and at least one aperture in the first wall;

a bracket coupled to the bottom end of the upright, the bracket having:

a first portion received within the aperture of the upright, extending within the interior of the upright and having a distal end releasably engaged with the second wall of the upright;

a second portion extending away from the upright to a location disposed from the upright; and a foot coupled to the second portion and positioned to rest upon the floor a distance from the upright.

13. The modular room upright assembly as claimed in claim 12, wherein the second wall of the upright is at least partially defined by an end wall of the upright capping the bottom end of the upright.

14. The modular room upright assembly as claimed in claim 13, wherein the end wall has an aperture therein through which an end of the first portion of the bracket extends to engage the end wall of the upright.

15. The modular room upright assembly as claimed in claim 12, wherein the first portion extends longitudinally within the interior of the upright to the bottom end of the upright.

16. The modular room upright assembly as claimed in claim 12, wherein the first portion extends through the bottom end of the upright.

17. The modular room upright assembly as claimed in claim 12, wherein the first portion of the bracket is received within an aperture in the second wall of the upright.

18. A modular room upright assembly for use in a modular room constructed upon a floor surface, the modular room upright assembly comprising:

a substantially vertical elongated upright having a longitudinal axis at a center of the upright;

a wall at least partially defining an interior of the upright, the wall terminating at an opening proximate a bottom of the upright; and at least one aperture in the wall;

a bracket coupled to the upright proximate the bottom of the upright, the bracket having:

a first portion received within the aperture of the upright, extending within the interior of the upright, and having a distal end releasably coupled to a second wall extending across the longitudinal axis of the upright; and a second portion extending away from the upright to a location disposed from the upright; and a foot coupled to the second portion and positioned to rest upon the floor a distance from the upright.

19. The modular room upright assembly as claimed in claim 18, wherein the second wall of the upright is at least partially defined by an end wall of the upright closing the bottom of the upright.

20. The modular room upright assembly as claimed in claim 19, wherein the end wall has an aperture therein through which an end of the first portion of the bracket extends to engage the end wall of the upright.

21. The modular room upright assembly as claimed in claim 18, wherein the first portion extends longitudinally within the interior of the upright to the bottom of the upright.

22. The modular room upright assembly as claimed in claim 18, wherein the first portion extends through the bottom of the upright.

23. The modular room upright assembly as claimed in claim 18, wherein the first portion of the bracket is received within an aperture in the second wall of the upright.

* * * * *

UNITED STATES PATENT AND TRADEMARK OFFICE

CERTIFICATE OF CORRECTION

PATENT NO. : 7,165,360 B2
APPLICATION NO. : 10/702339
DATED : January 23, 2007
INVENTOR(S) : Steven C. Thompson It is certified that error appears in the above-identified patent and that said Letters Patent is hereby corrected as shown below:

On the title page:

Please add:

--Related U.S. Application Data

(63) Continuation of application no. PCT/US02/14353, filed on May 6, 2002, which claims benefit of provisional application no. 60/289,263, filed May 7, 2001.--

Signed and Sealed this

Twelfth Day of February, 2008

JON W. DUDAS
*Director of the United States Patent and Trademark Office*